US008898820B2

(12) United States Patent
Sokolowski et al.

(10) Patent No.: US 8,898,820 B2
(45) Date of Patent: Dec. 2, 2014

(54) LAYERED APPAREL WITH ATTACHABLE AND DETACHABLE ELEMENTS

(75) Inventors: Susan L. Sokolowski, Portland, OR (US); James A. Niegowski, Portland, OR (US); Matthew F. Park, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 528 days.

(21) Appl. No.: 12/184,660

(22) Filed: Aug. 1, 2008

(65) Prior Publication Data

US 2010/0024100 A1 Feb. 4, 2010

(51) Int. Cl.

| | |
|---|---|
| ***A41D 13/015*** | (2006.01) |
| ***A41D 13/05*** | (2006.01) |
| ***A41D 1/00*** | (2006.01) |

(52) U.S. Cl.

CPC ..... *A41D 1/002* (2013.01); *A41D 13/0562* (2013.01); *A41D 2300/20* (2013.01)

USPC ..... 2/455; 2/23; 2/267; 2/456; 2/466

(58) Field of Classification Search

CPC ..... A41D 13/0058; A41D 13/0562

USPC ..... 2/244, 115, 80, 126, 23, 69, 108, 105, 2/106, 246, 49.1, 75, 247, 1, 22, 85, 93, 2/102, 227, 245, 267, 466, 269, 270, 274, 2/2.5, 79, 250–252, 239, 159, 414, 2/455–456; 40/586, 636, 329, 618

See application file for complete search history.

(56) References Cited

U.S. PATENT DOCUMENTS

| | | | | |
|---|---|---|---|---|
| 3,484,974 | A * | 12/1969 | Culmone | 40/586 |
| 3,950,789 | A | 4/1976 | Konz | |
| 4,249,268 | A * | 2/1981 | Berler | 2/115 |

(Continued)

FOREIGN PATENT DOCUMENTS

| | | |
|---|---|---|
| CN | 1857132 | 11/2006 |
| DE | 102005060624 | 5/2007 |

(Continued)

OTHER PUBLICATIONS

International Search Report and Written Opinion for PCT/US2009/50860, mailed on Jan. 26, 2010.

(Continued)

*Primary Examiner* — Khoa Huynh
*Assistant Examiner* — Khaled Annis
(74) *Attorney, Agent, or Firm* — Shook, Hardy & Bacon L.L.P.

(57) ABSTRACT

An article apparel has a surface with a first part of a fastening system, and an attachment element has an outer area with a second part of the fastening system. The first part of the fastening system is joinable to the second part of the fastening system to attach the attachment element to the apparel. The first part of the fastening system is also separable from the second part of the fastening system to separate the attachment element from the apparel. The attachment element may be formed from a polymer foam material, may include a fluid-filled chamber, or may incorporate an electronic device, for example. In some configurations, the attachment element is secured to an exterior of the apparel. In other configurations, the attachment element is secured between two layers of the apparel.

23 Claims, 30 Drawing Sheets

(56) References Cited

U.S. PATENT DOCUMENTS

| | | | | | |
|---|---|---|---|---|---|
| 4,345,958 | A * | 8/1982 | Kuroda | 156/221 |
| 4,384,369 | A * | 5/1983 | Prince | 2/79 |
| 4,407,497 | A * | 10/1983 | Gracie | 482/105 |
| 4,538,301 | A | 9/1985 | Sawatzki et al. | |
| 4,696,066 | A | 9/1987 | Ball | |
| 4,815,149 | A * | 3/1989 | Erhardt et al. | 2/403 |
| 5,048,123 | A * | 9/1991 | Monson | 2/69 |
| 5,048,125 | A * | 9/1991 | Libertini et al. | 2/79 |
| 5,054,127 | A * | 10/1991 | Zevchak | 2/247 |
| 5,136,726 | A * | 8/1992 | Kellin et al. | 2/244 |
| 5,155,869 | A * | 10/1992 | Ralli et al. | 2/268 |
| 5,334,082 | A | 8/1994 | Barker | |
| 5,427,563 | A | 6/1995 | Manning | |
| 5,454,743 | A * | 10/1995 | Simonson | 441/74 |
| 5,484,448 | A | 1/1996 | Steele | |
| 5,536,246 | A * | 7/1996 | Saunders | 602/19 |
| 5,539,934 | A | 7/1996 | Ponder | |
| 5,636,377 | A * | 6/1997 | Wiener | 2/465 |
| 5,659,898 | A * | 8/1997 | Bell, Jr. | 2/69 |
| 5,729,832 | A * | 3/1998 | Grilliot et al. | 2/23 |
| 5,734,991 | A | 4/1998 | Schmid | |
| 5,742,939 | A | 4/1998 | Williams | |
| 5,826,273 | A | 10/1998 | Eckes | |
| 5,860,163 | A | 1/1999 | Aldridge | |
| 5,953,757 | A * | 9/1999 | Blanks, I | 2/243.1 |
| 5,957,692 | A * | 9/1999 | McCracken et al. | 434/159 |
| 6,005,222 | A * | 12/1999 | Hicks | 219/211 |
| 6,041,436 | A * | 3/2000 | Keen | 2/69 |
| 6,093,468 | A | 7/2000 | Toms et al. | |
| 6,098,198 | A * | 8/2000 | Jacobs et al. | 2/69 |
| 6,139,928 | A * | 10/2000 | Sloot | 428/7 |
| 6,193,678 | B1 | 2/2001 | Brannon | |
| 6,228,108 | B1 | 5/2001 | Lamb | |
| 6,282,729 | B1 | 9/2001 | Oikawa et al. | |
| 6,289,524 | B1 * | 9/2001 | Wright et al. | 2/455 |
| 6,295,654 | B1 | 10/2001 | Farrell | |
| 6,453,477 | B1 * | 9/2002 | Bainbridge et al. | 2/455 |
| 6,484,325 | B1 | 11/2002 | Lazarus et al. | |
| 6,519,781 | B1 | 2/2003 | Berns | |
| 6,666,836 | B1 | 12/2003 | Islava | |
| 6,842,915 | B2 * | 1/2005 | Turner et al. | 2/459 |
| 6,936,021 | B1 * | 8/2005 | Smith | 602/19 |
| 6,982,115 | B2 | 1/2006 | Poulos et al. | |
| 7,065,793 | B1 | 6/2006 | Wooten | |
| 7,276,076 | B2 | 10/2007 | Bieberich | |
| 7,389,547 | B1 | 6/2008 | Wiens | |
| 2002/0184925 | A1 * | 12/2002 | McClellan et al. | 66/195 |
| 2003/0220048 | A1 | 11/2003 | Toro et al. | |
| 2003/0236053 | A1 * | 12/2003 | Martz | 450/39 |
| 2004/0019950 | A1 | 2/2004 | Rast | |
| 2005/0009445 | A1 * | 1/2005 | Bell et al. | 450/1 |
| 2005/0066407 | A1 * | 3/2005 | Delaney | 2/69 |
| 2005/0081277 | A1 * | 4/2005 | Matechen et al. | 2/102 |
| 2005/0085162 | A1 * | 4/2005 | Ott | 450/150 |
| 2005/0278817 | A1 | 12/2005 | Doheny | |
| 2006/0025039 | A1 * | 2/2006 | Barbour et al. | 450/1 |
| 2006/0099884 | A1 * | 5/2006 | Falla | 450/1 |
| 2006/0199456 | A1 | 9/2006 | Taylor | |
| 2006/0218692 | A1 | 10/2006 | Lamarque | |
| 2006/0277647 | A1 * | 12/2006 | Dobkin | 2/69 |
| 2007/0106352 | A1 | 5/2007 | Carstens | |
| 2007/0185425 | A1 * | 8/2007 | Einarsson et al. | 602/26 |
| 2007/0186327 | A1 * | 8/2007 | Hall et al. | 2/69 |
| 2007/0186328 | A1 * | 8/2007 | Bulian | 2/69 |
| 2007/0250976 | A1 | 11/2007 | Beliveau | |
| 2008/0040831 | A1 * | 2/2008 | Nilforushan et al. | 2/69 |
| 2008/0060113 | A1 * | 3/2008 | Walsh | 2/116 |

FOREIGN PATENT DOCUMENTS

| | | |
|---|---|---|
| EP | 0962156 | 12/1999 |
| JP | 4-33608 | 3/1992 |
| JP | 10-146356 | 2/1998 |
| JP | 10-237708 | 9/1998 |
| JP | 3074372 | 10/2000 |
| JP | 2002-038301 | 2/2002 |
| JP | 2003-105607 | 4/2003 |
| JP | 2006-028665 | 2/2006 |
| JP | 3120254 | 3/2006 |
| JP | 2006-239394 | 9/2006 |
| JP | 2008-111213 | 5/2008 |
| WO | 2004019713 | 3/2004 |
| WO | WO2004019713 | 3/2004 |

OTHER PUBLICATIONS

English Translation of Office Action in Japanese Patent Application No. 2011-521180, issued on Nov. 20, 2012.

English Translation of Office Action in Japanese Patent Application No. 2011-521164 issued on Sep. 6, 2012.

International Search Report and Written Opinion in PCT Application No. PCT/US2009/050099 mailed on May 27, 2010.

Final Office Action in U.S. Appl. No. 12/184,650 issued on Sep. 14, 2011.

Final Office Action in U.S. Appl. No. 12/184,650 issued on May 21, 2012.

Non-Final Office Action in U.S. Appl. No. 12/184,650 issued on Jan. 29, 2013.

International Preliminary Report on Patentability mailed Feb. 10, 2011 in International Application No. PCT/US2009/050860.

Final Office Action in U.S. Appl. No. 13/168,220 mailed Mar. 26, 2013.

Office Action mailed Apr. 24, 2013 in U.S. Appl. No. 12/184,650.

English Translation of the Chinese Office Action dated Jan. 10, 2013 in Chinese Patent Application No. 200980129946.5.

English Translation of the Japanese Office Action dated May 16, 2013 in Japanese Patent Application No. 2011-521164.

International Preliminary Report on Patentability (including Written Opinion of the ISA) mailed Jan. 9, 2014 in International Application No. PCT/US2012/043170.

Examiner's Answer Before the Patent Trial and Appeal Board mailed Mar. 12, 2014 in U.S. Appl. No. 13/168,220.

* cited by examiner

LAYERED APPAREL WITH ATTACHABLE AND DETACHABLE ELEMENTS

BACKGROUND

Articles of apparel intended for use during athletic activities generally exhibit characteristics that enhance the performance, comfort, or protection of a wearer. As an example, apparel may incorporate a stretch material that provides a relatively tight fit, thereby imparting the wearer with a lower profile that minimizes wind resistance. Apparel may also be formed from a material that wicks moisture away from the wearer in order to reduce the quantity of perspiration that accumulates adjacent to the skin. Furthermore, apparel may incorporate materials that attenuate compression forces (i.e., impart padding or cushioning) to provide impact protection to areas of the wearer. Accordingly, the configurations of articles of apparel for athletic activities may be specifically selected to enhance the performance or comfort of the wearer.

SUMMARY

Various apparel systems are disclosed below as including an article of apparel and at least one attachment element. The apparel has a surface with a first part of a fastening system, and the attachment element has an outer area with a second part of the fastening system. The first part of the fastening system is joinable to the second part of the fastening system to attach the attachment element to the apparel. The first part of the fastening system is also separable from the second part of the fastening system to separate the attachment element from the apparel. The attachment element may be formed from a polymer foam material, may include a fluid-filled chamber, or may incorporate an electronic device, for example. In some configurations, the attachment element is secured to an exterior of the apparel. In other configurations, the attachment element is secured between two layers of the apparel.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose concepts associated with various articles of apparel and attachment elements. In general, the attachment elements may be repeatedly attached to and detached from various areas of the apparel. A variety of attachment element configurations may be utilized, depending upon the activities, particular needs, and preferences of a wearer. For example, the attachment elements may be (a) foam members, gas-filled chambers, or plates that attenuate compression forces (i.e., impart padding or cushioning) to provide impact protection to areas of the wearer where the attachment elements are located, (b) liquid-filled chambers that impart either heating or cooling to areas of the wearer where the attachment elements are located, or (c) electronic devices that provide information or enjoyment to the wearer, such as, mobile phones, portable music players, timing devices, heart-rate monitors, locator beacons, global positioning systems, or mobile computing devices.

Although a variety of types of apparel may be utilized with the attachment elements, examples of both shirt-type garments and pants-type garments are disclosed in the following discussion and accompanying figures. Shirt-type garments include any of a plurality of garments that cover a portion of a torso of the wearer and may extend over arms of the wearer. Examples of shirt-type garments include long-sleeved shirts, short-sleeved shirts, tank tops, undershirts, jackets, and coats. Similarly, pants-type garments include any of a plurality of garments that cover a portion of a pelvic region of the wearer and may extend over legs of the wearer. Examples of pants-type garments include pants, shorts, briefs, jeans, and underwear. In some configurations, the articles of apparel may be combinations of shirt-type garments and pants-type garments, including bodysuits, leotards, unitards, and wetsuits. In addition, the articles of apparel may have configurations that cover other areas of the wearer, such as hats, helmets, gloves, socks, and footwear, for example. Accordingly, a variety of types of articles of apparel may be utilized.

First Shirt-Type Garment Configuration

Figure 1:
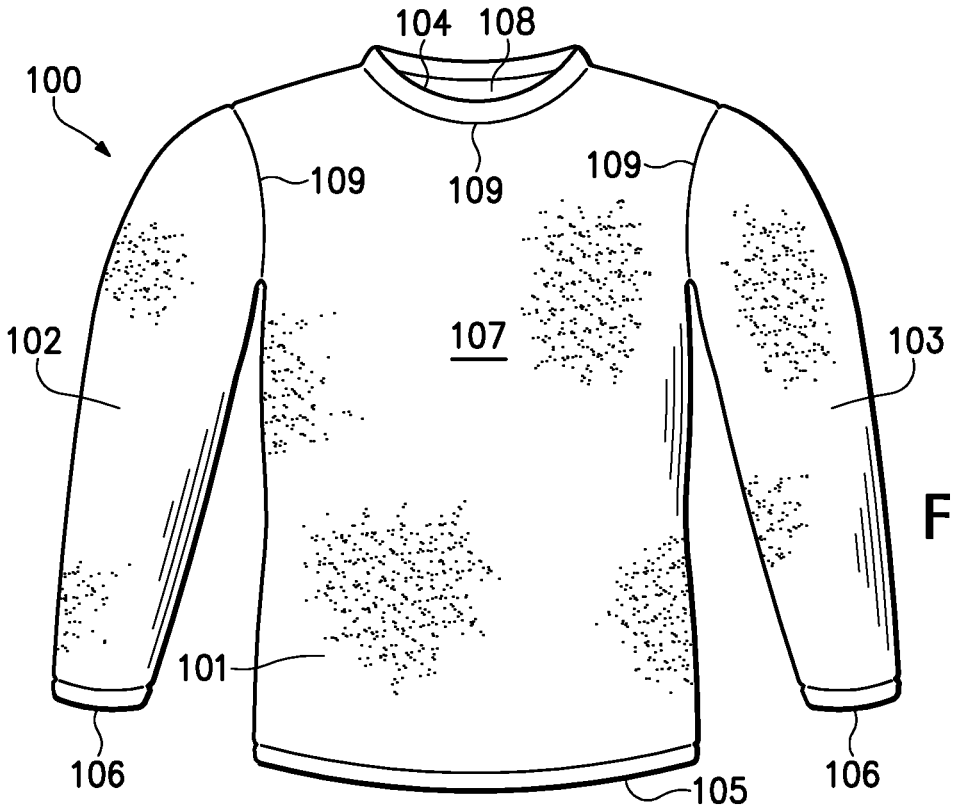
FIG. 1 is a front elevational view of a first article of apparel.

An article of apparel 100 having the configuration of a shirt-type garment is depicted in FIG. 1. Apparel 100 includes a torso region 101 and a pair of arm regions 102 and 103 that extend outward from torso region 101. Torso region 101 corresponds with a torso of a wearer and covers at least a portion of the torso when worn. An upper area of torso region 101 defines a neck opening 104 through which the neck and head of the wearer protrude when apparel 100 is worn. Similarly, a lower area of torso region 101 defines a waist opening 105 through which the waist or pelvic area of the wearer protrudes when apparel 100 is worn. Arm region 102 corresponds with a right arm of the wearer and covers at least a portion of the right arm, and arm region 103 corresponds with a left arm of the wearer and covers at least a portion of the left arm. Each of arm regions 102 and 103 define a wrist opening 106 through which a hand and wrist of the wearer protrude when apparel 100 is worn. Additionally, apparel 100 includes an outer surface 107 that faces away from the wearer, and apparel 100 includes an inner surface 108 that faces toward the wearer and may contact the wearer when apparel 100 is worn.

Figure 2A:
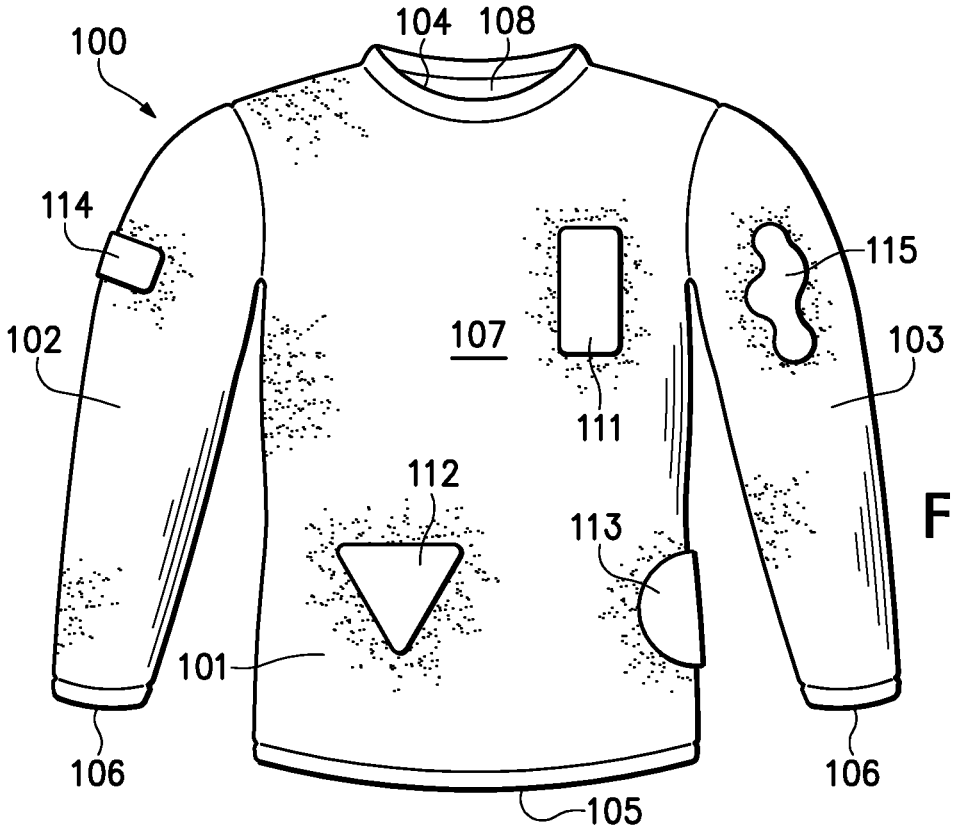
FIGS. 2A-2C are front elevational views of the first article of apparel in combination with a plurality of attachment elements.

A variety of attachment elements 111-115 are secured to apparel 100, as depicted in FIG. 2A. More particularly, attachment elements 111-115 may be secured to outer surface 107 in any of torso region 101 and arm regions 102 and 103, although attachment elements 111-115 may be secured to inner surface 108 in some configurations of apparel 100. Attachment elements 111-115 may be any of foam members, fluid-filled chambers (e.g., gas-filled or liquid-filled), plates, or electronic devices, for example. Similarly, the shapes and sizes of attachment elements 111-115 may vary significantly. For example, attachment elements 111 and 114 exhibit generally rectangular configurations, whereas attachment element 112 is generally triangular, attachment element 113 is generally circular, and attachment element 115 exhibits a non-geometrical form. The thicknesses of attachment elements 111-115 may also vary significantly to include generally flat, non-uniform, or protruding configurations, depending upon the composition and intended use of attachment elements 111-115. Accordingly, the configurations of attachment elements 111-115 may vary significantly.

Attachment elements 111-115 are secured to apparel 100 in a variety of different locations. More particularly, attachment element 111 is secured to an upper area of torso region 101, attachment element 112 is secured to a lower area of torso region 101, attachment element 113 is secured to a side area of the torso region 101, attachment element 114 is secured to arm region 102, and attachment element 115 is secured to arm region 103. Apparel 100 and attachment elements 111-115 each incorporate portions of a fastening system that is utilized to secure attachment elements 111-115 to outer surface 107. A variety of fastening systems may be utilized, including hook-and-loop fastening systems (e.g., VELCRO, which is manufactured by VELCRO USA, Inc. of Manchester, N.H., United States of America), magnetic fastening systems, adhesive fastening systems, and button-type fastening systems, for example. For purposes of reference, portions of apparel 100, other articles of apparel, and other elements incorporating the fastening system or a part of the fastening system are depicted as having a stippled or otherwise textured configuration in the figures.

Figure 2B:
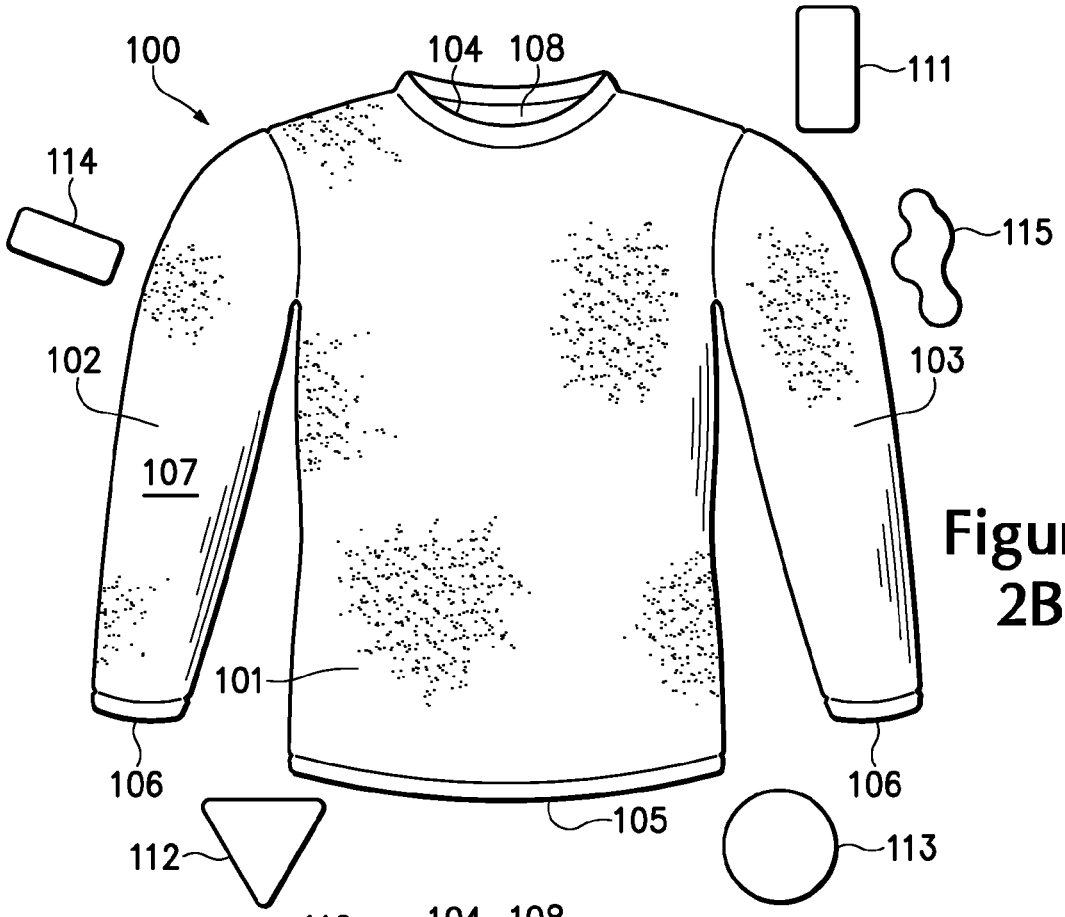
Figure 2C:
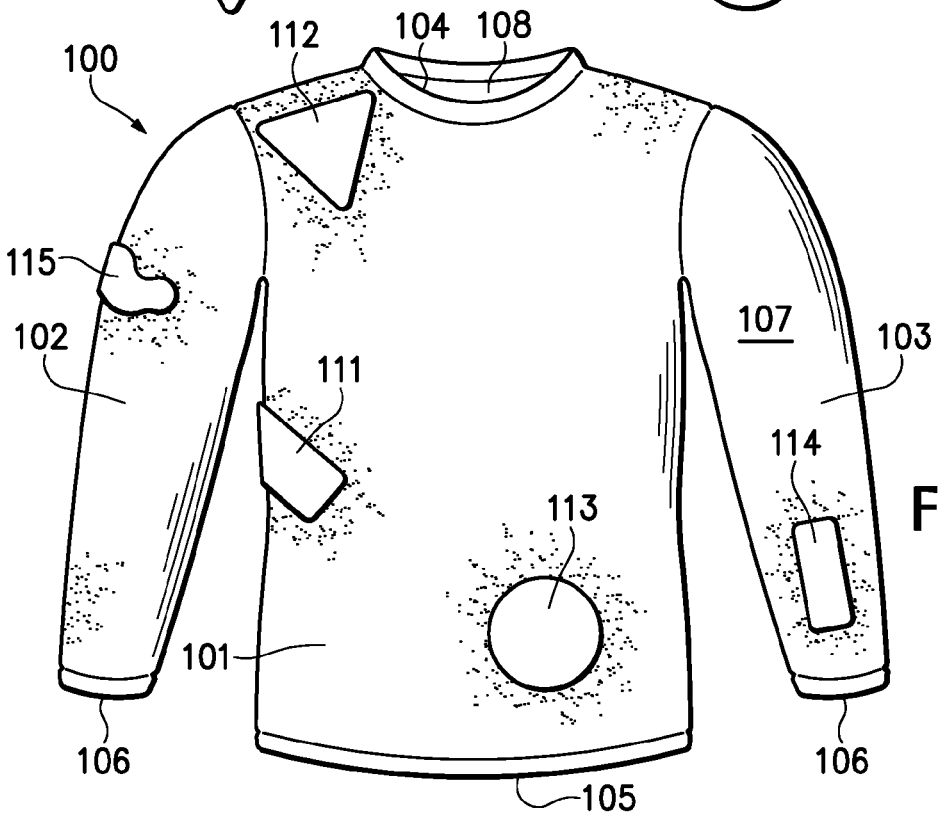

In addition to attaching or otherwise securing attachment elements 111-115 to apparel 100, the fastening system permits attachment elements 111-115 to be detached or otherwise separated from apparel 100. Referring to FIG. 2B, therefore, each of attachment elements 111-115 are depicted as being separated from apparel 100. Moreover, the fastening system also permits attachment elements 111-115 to be (a) repeatedly attached to and detached from apparel 100, (b) attached to apparel 100 in a variety of different locations, and (c) attached in a variety of different orientations. Referring to FIG. 2C, therefore, each of attachment elements 111-115 are depicted as being re-attached to apparel 100 in different locations and with different orientations.

A variety of materials may be utilized in manufacturing apparel 100. In general, apparel 100 may be formed from knitted, woven, or non-woven textile materials that include rayon, nylon, polyester, polyacrylic, cotton, wool, or silk, for example. Although apparel 100 may be knitted as a unitary (i.e., one-piece) article, apparel 100 may also be formed from a plurality of textile elements that are sewn, bonded, adhered, or otherwise joined together to form torso region 101 and arm regions 102 and 103. As depicted in FIG. 1, for example, a variety of seams 109 join textile elements that form arm regions 102 and 103 to textile elements that form torso region 101, and a seam 109 joins a collar in the area of neck opening 104. In some configurations, the textile materials may include coatings that form a breathable and water-resistant barrier, or polymer sheets may be utilized in place of textile materials. Apparel 100 may also be formed from laminated or otherwise layered materials that include two or more layers of textile materials, polymer sheets, or combinations of textile materials and polymer sheets.

Depending upon the specific fastening system that is utilized for attachment elements 111-115, apparel 100 may also incorporate elements related to the fastening system. For example, magnetic elements or buttons may be incorporated into the textile materials of apparel 100 when a magnetic fastening system or a button-type fastening system is utilized. As another example, elements of either a hook part or a loop part of a hook-and-loop fastening system may be secured to apparel 100 in order to form a portion of outer surface 107. Alternatively, the textile material forming apparel 100 may be manufactured to define the hook part or the loop part of the hook-and-loop fastening system. That is, the hook part or the loop part of the hook-and-loop fastening system may be knitted as an integral part of the textile material forming apparel 100. An advantage of this configuration is that additional elements (e.g., magnetic elements, buttons, strips of the hook part or the loop part) are absent from apparel 100, which decreases the number of components within apparel 100 and simplifies the overall manufacturing process. An example of a suitable material incorporating the loop part of the hook-and-loop fastening system is manufactured by RUEY TAY of Taipei, Taiwan, Republic of China and is a warp knit mesh that includes ninety-one percent polyester having 1/75/72 textured microfiber semi-dull and nine percent spandex (i.e., elastane).

Apparel 100 is depicted as having the configuration of a shirt-type garment, particularly a long-sleeved shirt. In some configurations, apparel 100 may be intended for use as a compression garment. In addition to therapeutic uses, compression garments are often worn by athletes as a base layer under jerseys or other athletic apparel. In general, compression garments or other garments intended as base layers (a) exhibit a relatively tight fit that lays adjacent to the skin of the wearer and (b) stretch to conform with the contours of the wearer. While the textile materials forming compression garments may have one-directional stretch of, for example, more than ten percent prior to tensile failure, the textile materials forming other compression garments have two-directional stretch of at least thirty percent prior to tensile failure. Accordingly, when apparel 100 is formed to have a relatively tight fit and to stretch to conform with the contours of the wearer, the textile materials forming apparel 100 may have two-directional stretch of at least thirty percent prior to tensile failure.

Substantially all of outer surface 107 has a configuration that provides locations for securing attachment elements 111-115. That is, at least ninety percent of outer surface 107 provides locations for securing attachment elements 111-115. When, for example, the loop part of the hook-and-loop fastening system is knitted as an integral part of the textile material forming apparel 100, substantially all of outer surface 107 may be formed from the textile material. In some configurations, however, only portions of outer surface 107 may provide locations for securing attachment elements 111-115. That is, a part of the fastening system may be absent from portions of outer surface 107 or textile materials that do not provide locations for securing attachment elements 111-115 may be utilized for portions of outer surface 107.

Figure 3A:
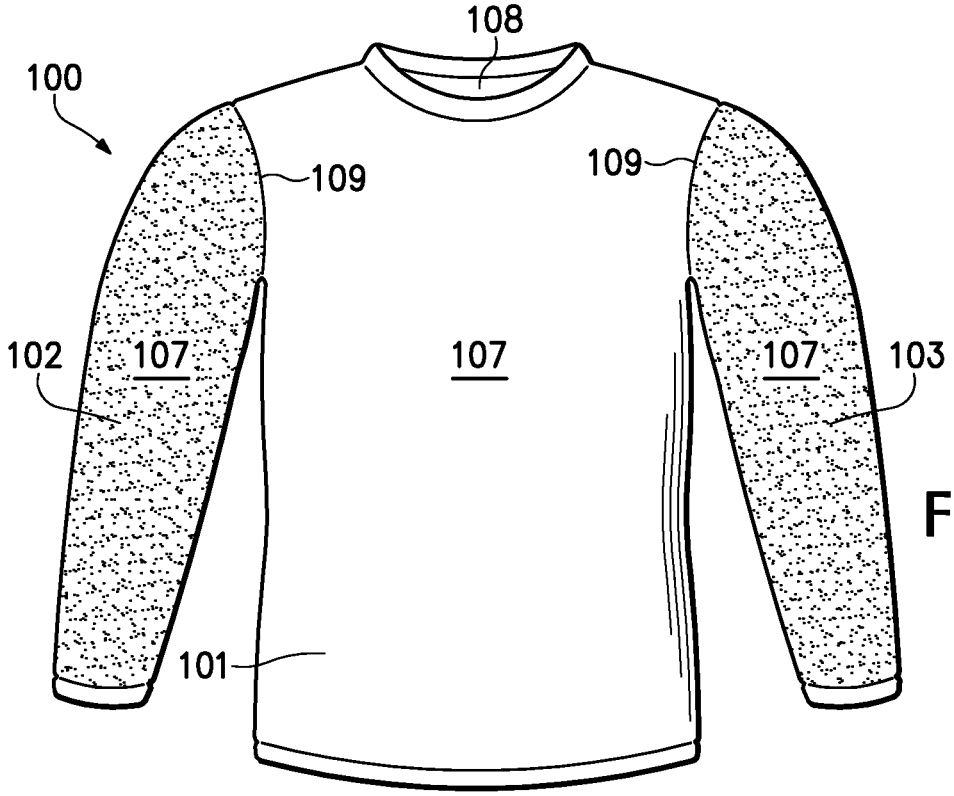
FIGS. 3A-3E are a front elevational views of further configurations of the first article of apparel.
Figure 3B:
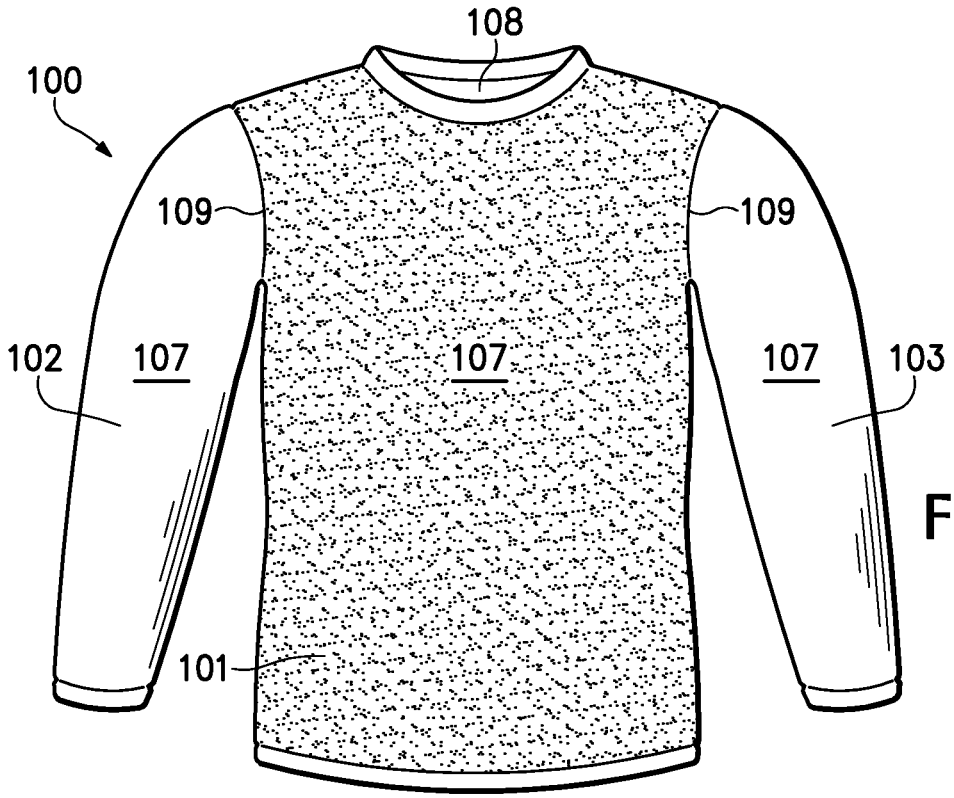
Figure 3C:
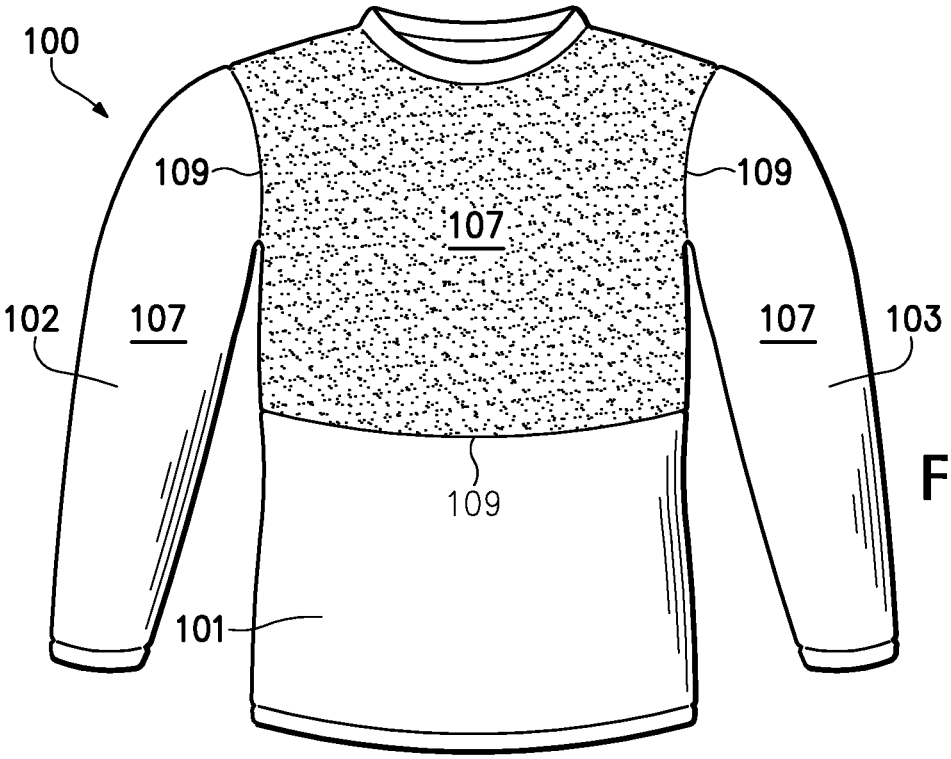
Figure 3D:
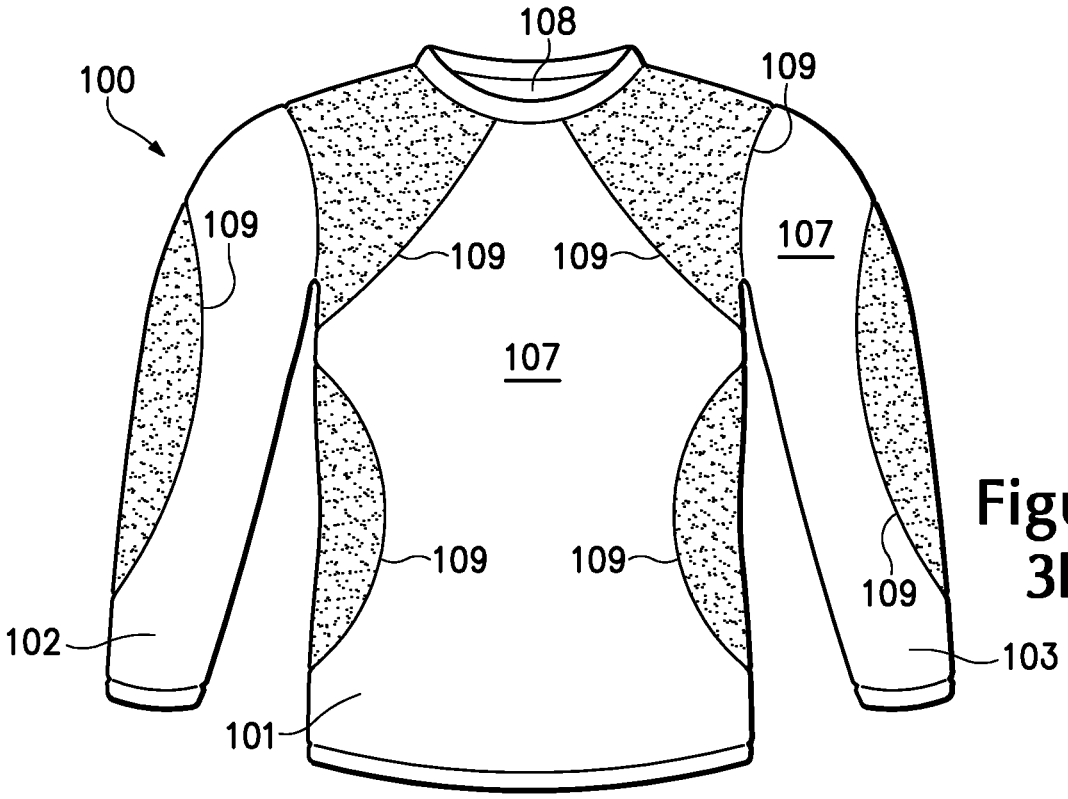
Figure 3E:
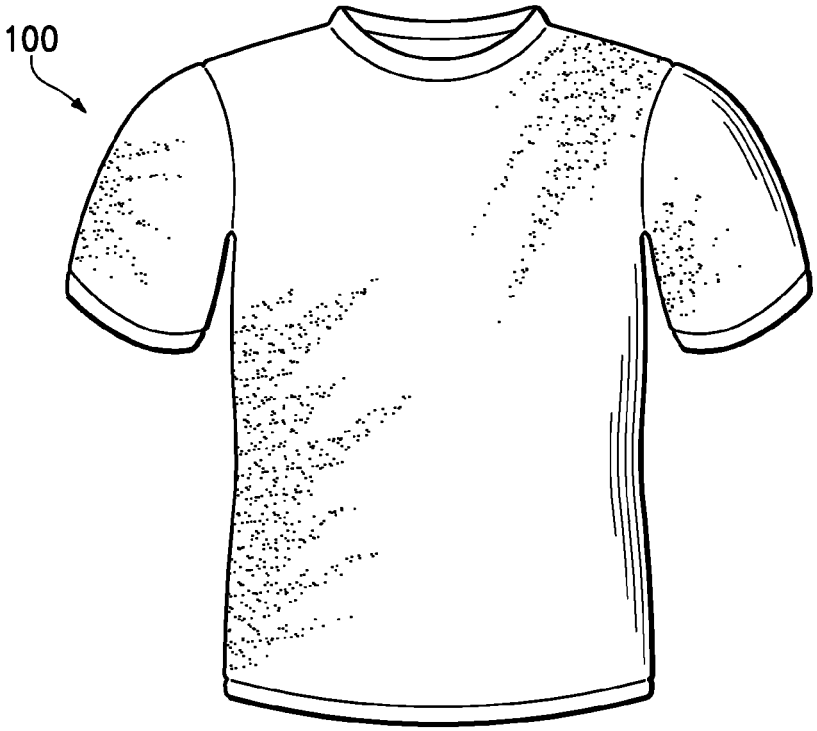

Although substantially all of outer surface 107 may have a configuration that provides locations for securing attachment elements 111-115, apparel 100 is depicted in FIG. 3A as having a configuration wherein the fastening system is absent from torso region 101. Given that portions of apparel 100 incorporating the fastening system or a part of the fastening system are depicted as having a stippled or otherwise textured configuration in the figures, areas without the stippled or otherwise textured configuration represent areas where the fastening system or a part of the fastening system is absent. Similarly, FIG. 3B depicts a configuration wherein the fastening system is absent in arm regions 102 and 103, but forms at least seventy-five percent of outer surface 107. A configuration wherein the fastening system is present in only central and upper areas of torso region 101, but forms at least fifty percent of outer surface 107, is depicted in FIG. 3C. Additionally, a configuration wherein the fastening system is present in only selected areas of regions 101-103 is depicted in FIG. 3D. In each of the configurations of FIGS. 3A-3D, seams 109 may be utilized to join textile elements without the fastening system to textile elements with the fastening system. Although apparel 100 is depicted as having the configuration of a long-sleeved shirt in each of FIGS. 1-3D, concepts associated with apparel 100 may also incorporated into other shirt-type garments. As an example, apparel 100 is depicted as having the configuration of a short-sleeved shirt in FIG. 3E, but may also be a tank top, undershirt, jacket, or coat.

First Pants-Type Garment Configuration

Figure 4:
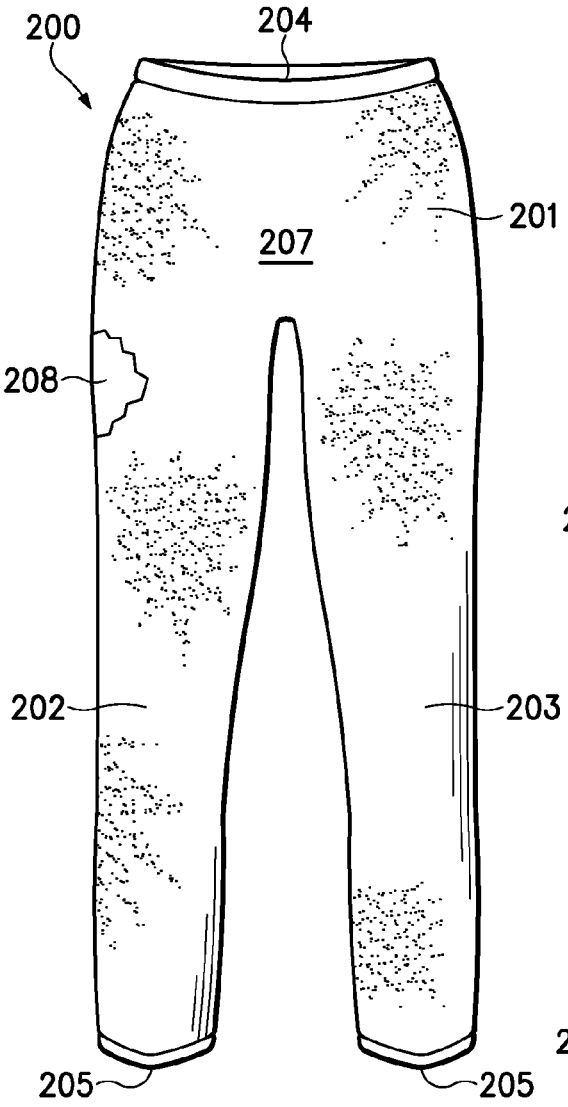
FIG. 4 is a front elevational view of a second article of apparel.

An article of apparel 200 having the configuration of a pants-type garment is depicted in FIG. 4. Apparel 200 includes a pelvic region 201 and a pair of leg regions 202 and 203 that extend outward from pelvic region 201. Pelvic region 201 corresponds with a pelvic area of a wearer and covers at least a portion of the pelvic area when worn. An upper area of pelvic region 201 defines a waist opening 204 that extends around the waist when apparel 200 is worn. Leg region 202 corresponds with a right leg of the wearer and covers at least a portion of the right leg, and leg region 203 corresponds with a left leg of the wearer and covers at least a portion of the left leg. Each of leg regions 202 and 203 define an ankle opening 205 through which a foot and ankle of the wearer protrude when apparel 200 is worn. Additionally, apparel 200 includes an outer surface 207 that faces away from the wearer, and apparel 200 includes an inner surface 208 that faces toward the wearer and may contact the wearer when apparel 200 is worn.

Figure 5A:
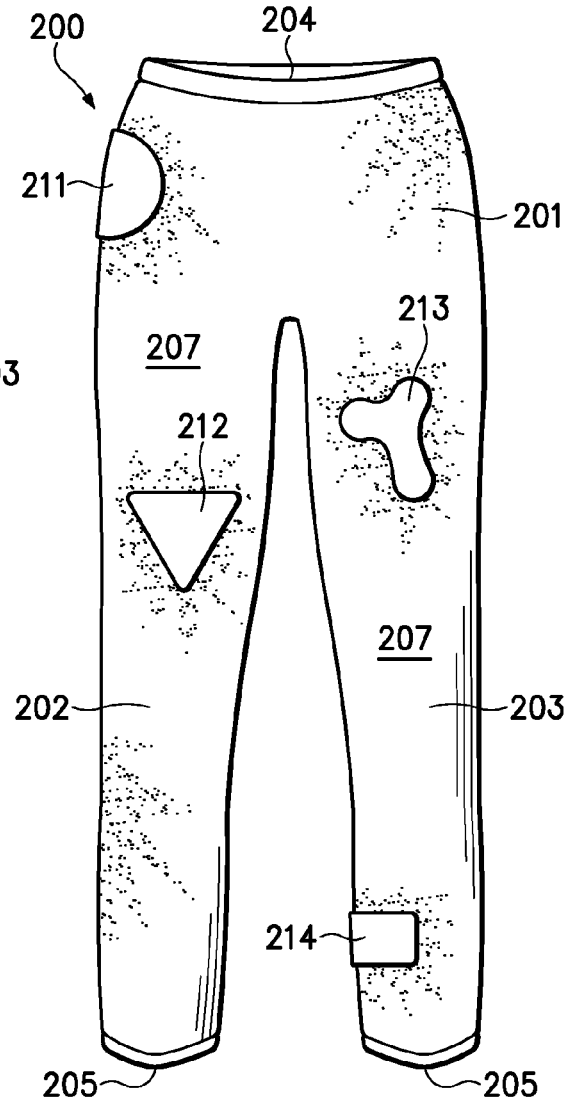
FIGS. 5A-5C are front elevational views of the second article of apparel in combination with a plurality of attachment elements.

A variety of attachment elements 211-214 are secured to apparel 200, as depicted in FIG. 5A. More particularly, attachment elements 211-214 may be secured to outer surface 207 in any of pelvic region 201 and leg regions 202 and 203, although attachment elements 211-214 may be secured to inner surface 208 in some configurations of apparel 200. As with attachment elements 111-115, attachment elements 211-214 may be any of foam members, fluid-filled chambers (e.g., gas-filled or liquid-filled), plates, or electronic devices. Similarly, the shapes, sizes, and thicknesses of attachment elements 211-214 may vary. Accordingly, the configurations of attachment elements 211-214 may vary significantly.

Attachment elements 211-214 are secured to apparel 200 in a variety of different locations. As with apparel 100 and attachment elements 111-115, apparel 200 and attachment elements 211-214 each incorporate portions of a fastening system that is utilized to secure attachment elements 211-214 to outer surface 107. A variety of fastening systems may be utilized, including hook-and-loop fastening systems, magnetic fastening systems, adhesive fastening systems, and button-type fastening systems, for example. For purposes of reference, portions of apparel 200 and other elements incorporating the fastening system or a part of the fastening system are depicted as having a stippled or otherwise textured configuration in the figures.

Figure 5B:
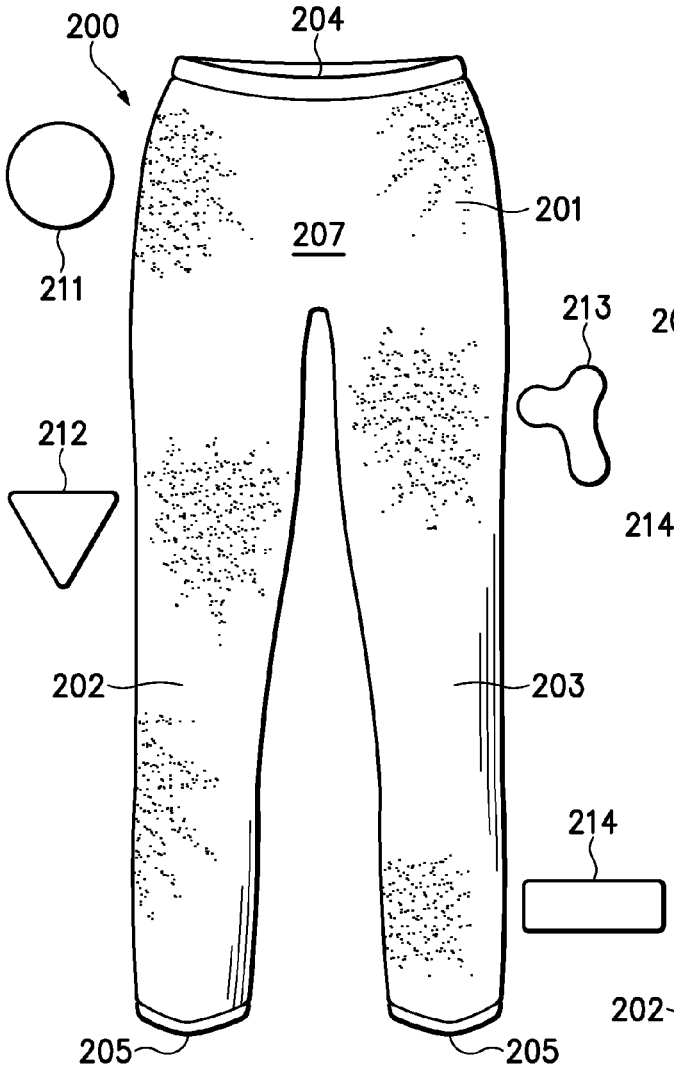
Figure 5C:
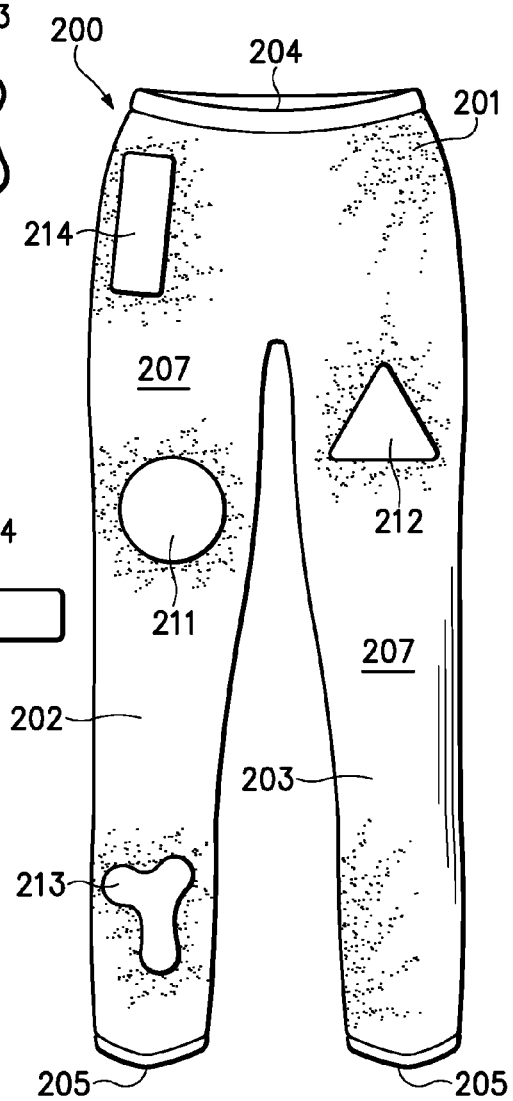

In addition to attaching or otherwise securing attachment elements 211-214 to apparel 200, the fastening system permits attachment elements 211-214 to be detached or otherwise separated from apparel 200. Referring to FIG. 5B, therefore, each of attachment elements 211-214 are depicted as being separated from apparel 200. Moreover, the fastening system also permits attachment elements 211-214 to be (a) repeatedly attached to and detached from apparel 200, (b) attached to apparel 200 in a variety of different locations, and (c) attached in a variety of different orientations. Referring to FIG. 5C, therefore, each of attachment elements 211-214 are depicted as being re-attached to apparel 200 in different locations and with different orientations.

Any of the materials discussed above for apparel 100 may be utilized in manufacturing apparel 200. Depending upon the specific fastening system that is utilized for attachment elements 211-214, apparel 200 may also incorporate elements related to the fastening system. For example, magnetic elements or buttons may be incorporated into the textile materials of apparel 200 when a magnetic fastening system or a button-type fastening system is utilized. As another example, elements of either a hook part or a loop part of a hook-and-loop fastening system may be secured to apparel 200 in order to form a portion of outer surface 207. Alternatively, the hook part or the loop part of the hook-and-loop fastening system may be knitted as an integral part of the textile material forming apparel 200.

Apparel 200 is depicted as having the configuration of a pants-type garment, particularly a pair of pants. In some configurations, apparel 200 may be intended for use as a compression garment that (a) exhibits a relatively tight fit that lays adjacent to the skin of the wearer and (b) stretches to conform with the contours of the wearer. Although the textile materials of apparel 200 may have one-directional stretch, the textile materials forming apparel 200 may have two-directional stretch of at least thirty percent prior to tensile failure.

Substantially all of outer surface 207 has a configuration that provides locations for securing attachment elements 211-214. That is, at least ninety percent of outer surface 207 provides locations for securing attachment elements 211-214. When, for example, the loop part of the hook-and-loop fastening system is knitted as an integral part of the textile material forming apparel 200, substantially all of outer surface 207 may be formed from the textile material. In some configurations, however, only portions of outer surface 207 may provide locations for securing attachment elements 211-214. That is, a part of the fastening system may be absent from portions of outer surface 207 or textile materials that do not provide locations for securing attachment elements 211-214 may be utilized for portions of outer surface 207.

Figure 6A:
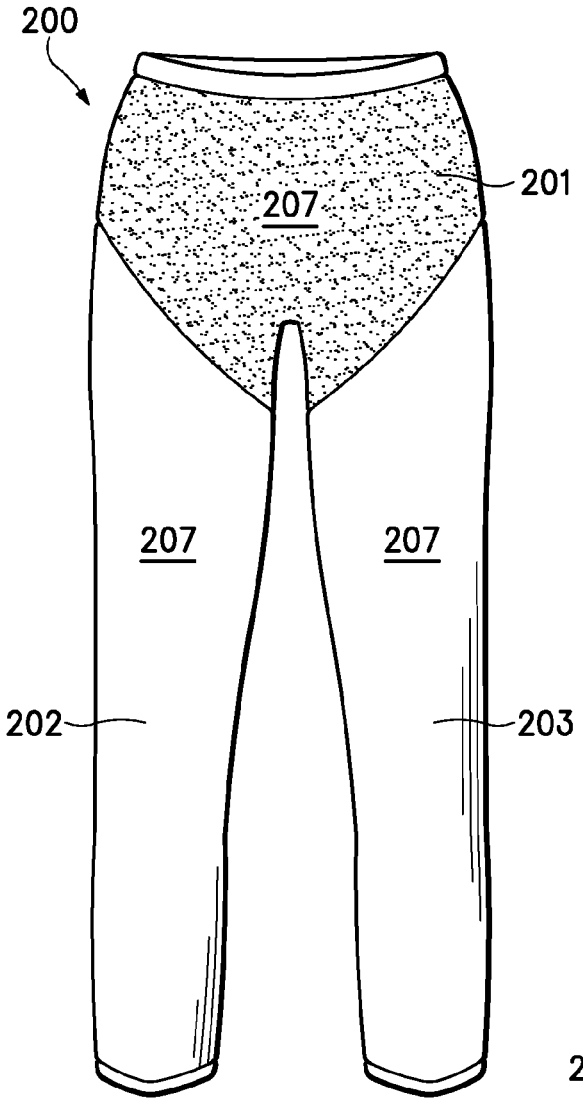
FIGS. 6A-6E are a front elevational views of further configurations of the second article of apparel.
Figure 6B:
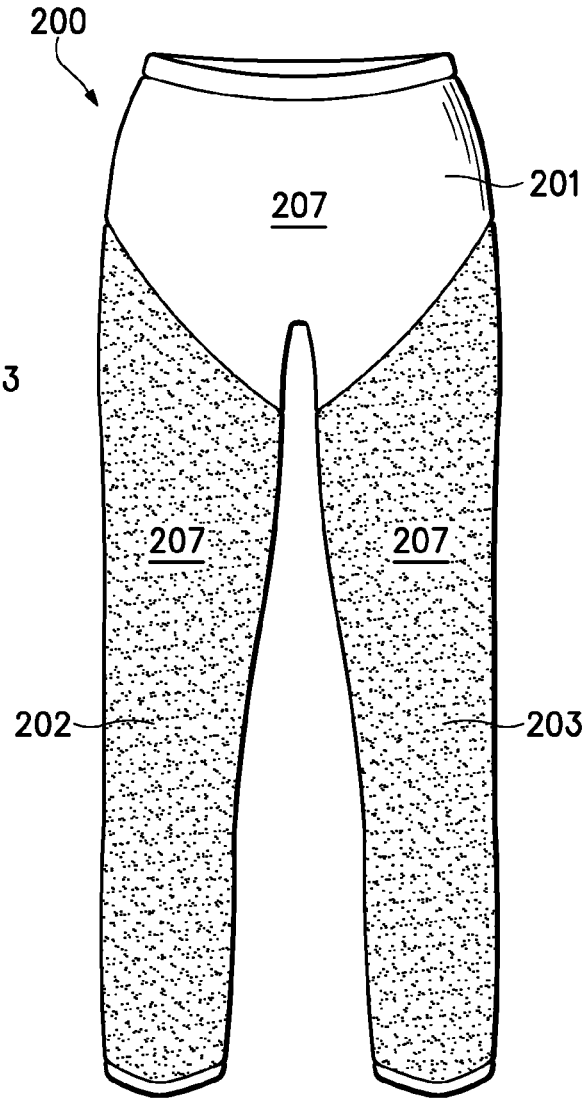
Figure 6C:
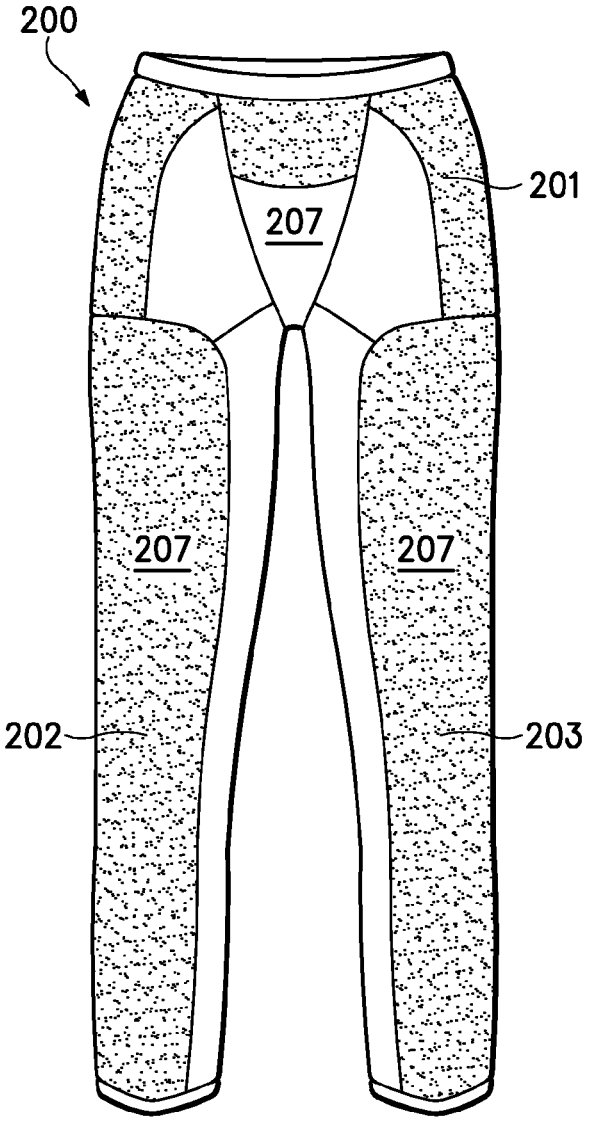
Figure 6D:
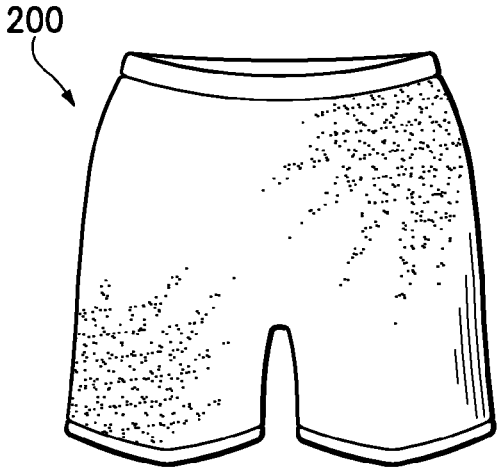
Figure 6E:
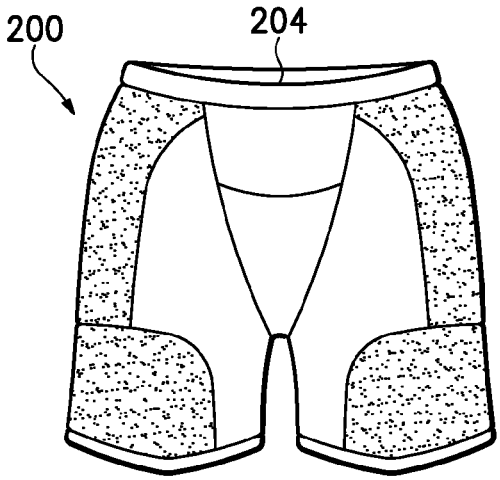

Apparel 200 is depicted in a configuration wherein the fastening system is absent from a majority of leg regions 202 and 203 in FIG. 6A. Given that portions of apparel 100 incorporating the fastening system or a part of the fastening system are depicted as having a stippled or otherwise textured configuration in the figures, areas without the stippled or otherwise textured configuration represent areas where the fastening system or a part of the fastening system is absent. FIG. 6B depicts a configuration wherein the fastening system is absent from pelvic region 201, but forms at least seventy-five percent of outer surface 207. Additionally, a configuration wherein the fastening system is present in only selected areas of regions 201-203 is depicted in FIG. 6C. Although apparel 200 is depicted as having the configuration of a pair of pants in each of FIGS. 4-6C, concepts associated with apparel 200 may also incorporated into other pants-type garments. As an example, apparel 200 is depicted as having the configuration of a pair of shorts in FIG. 6D, but may also be briefs, jeans, or underwear. Furthermore, a shorts configuration wherein the fastening system is present in at least fifty percent of the outer surface is depicted in FIG. 6E.

Attachment Element Configurations

Attachment elements 111-115 and 211-214 may exhibit a variety of different configurations, depending upon the activities, particular needs, and preferences of a wearer. As discussed above, attachment elements 111-115 and 211-214 may be (a) foam members, gas-filled chambers, or plates, (b) liquid-filled chambers, or (c) electronic devices, such as, mobile phones, portable music players, timing devices, locator beacons, global positioning systems, or mobile computing devices. Moreover, the shapes, sizes, and thicknesses, for example, of attachment elements 111-115 and 211-214 may vary significantly. In general, however, each of attachment elements 111-115 and 211-214 incorporate a part of the fastening system that permits attachment elements 111-115 and 211-214 to be (a) repeatedly attached to and detached from apparel 100 and apparel 200, (b) attached to apparel 100 and apparel 200 in a variety of different locations, and (c) attached in a variety of different orientations.

Figure 8:
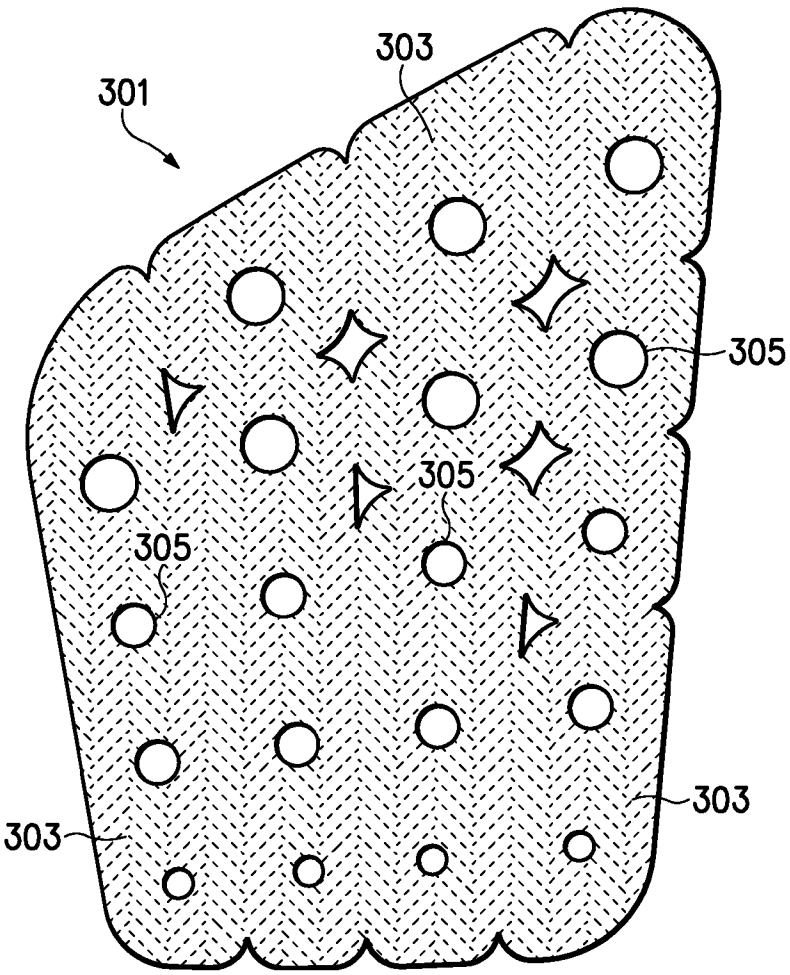
FIG. 8 is a bottom plan view of the first attachment element.
Figure 7:
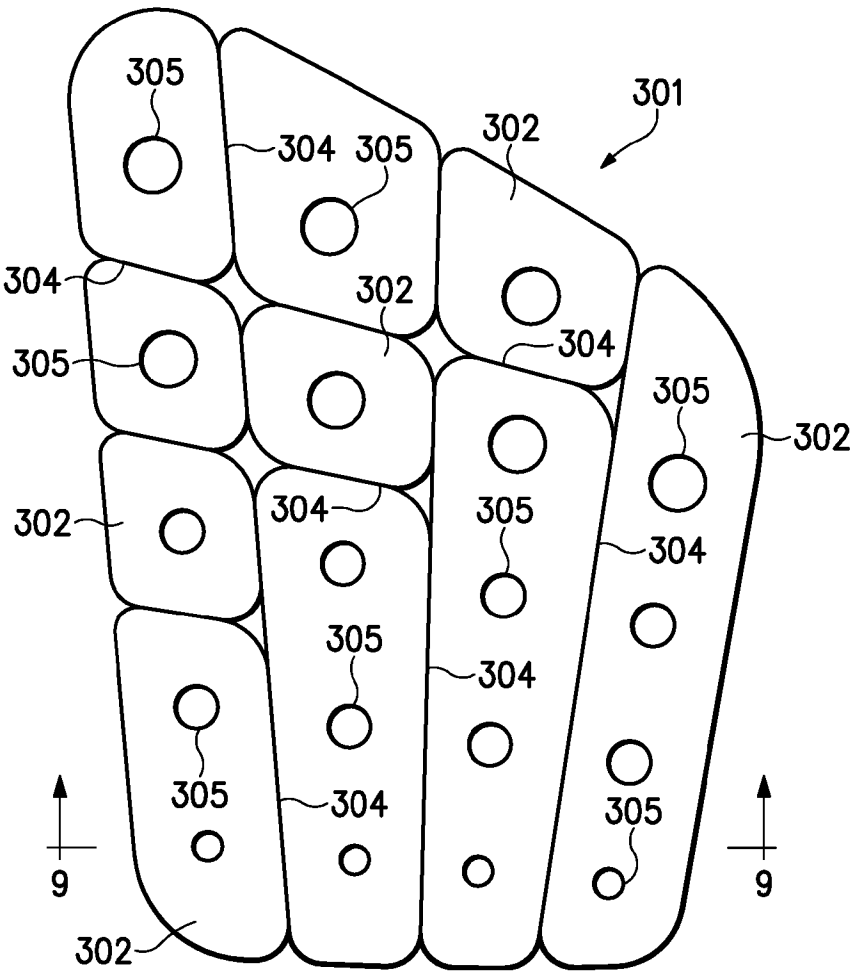
FIG. 7 is a top plan view of a first attachment element.
Figure 9:
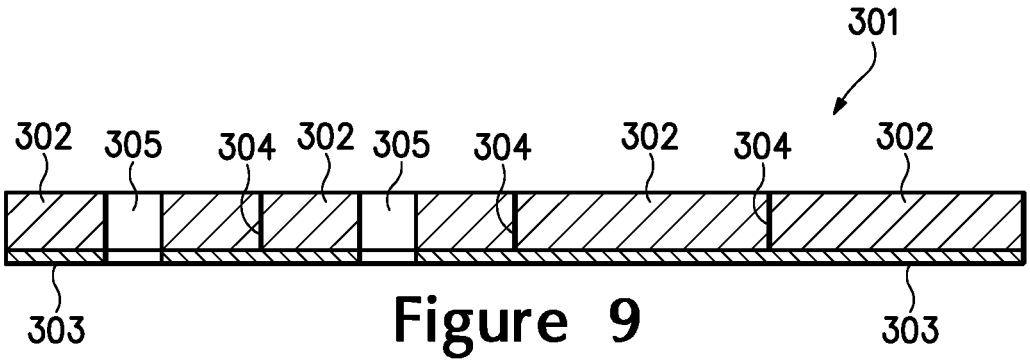
FIG. 9 is a cross-sectional view of the first attachment element, as defined by section line 9-9 in FIG. 7.

A more specific example of an attachment element 301 is depicted in FIGS. 7-9 as including a plurality of portions 302 that are joined by a fastening part 303. Portions 302 may be formed from a polymer foam material, for example, and are separated from each other by a plurality of incisions 304. Each of portions 302 may also include at least one aperture 305, which enhances breathability and reduces the overall weight of attachment element 301. Fastening part 303 is secured to each of portions 302 and generally incorporates a part of the fastening system that secures attachment element 301 to apparel 100 or apparel 200. When, for example, the textile material forming apparel 100 or apparel 200 incorporates the loop part of the hook-and-loop fastening system, fastening part 303 may incorporate the hook part of the hook-and-loop fastening system.

Figure 10:
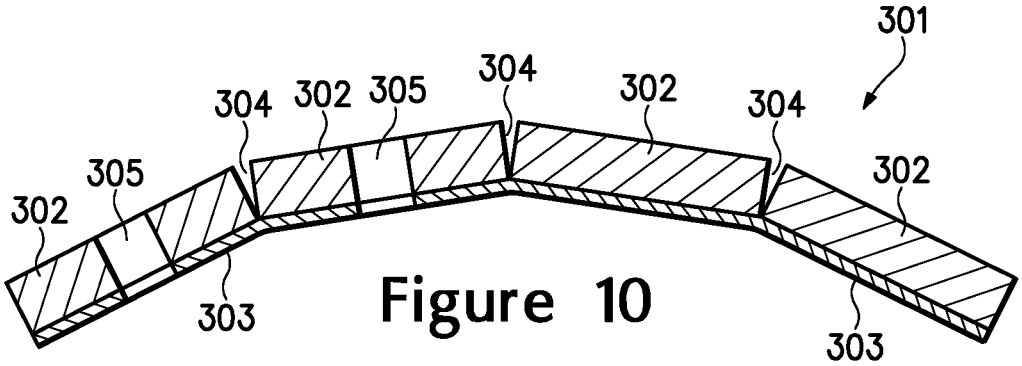
FIG. 10 is a cross-sectional view corresponding with FIG. 9 and depicting the first attachment element in a flexed configuration.
Figure 11A:
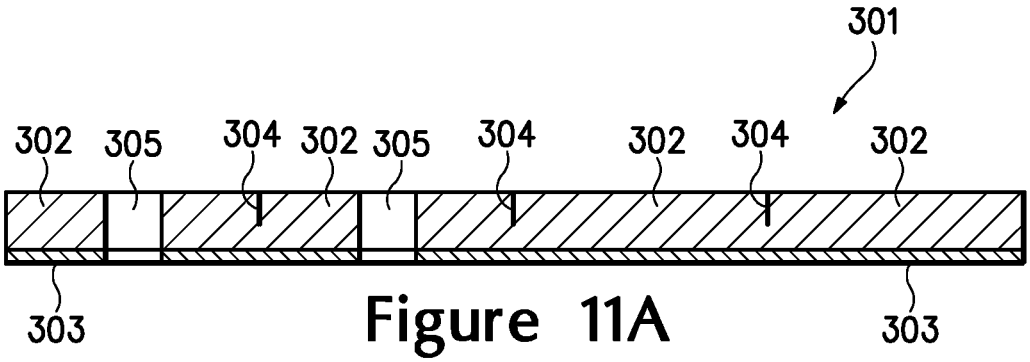
FIGS. 11A-11D are cross-sectional views corresponding with FIG. 9 and depicting further configurations of the first attachment element.
Figure 11B:
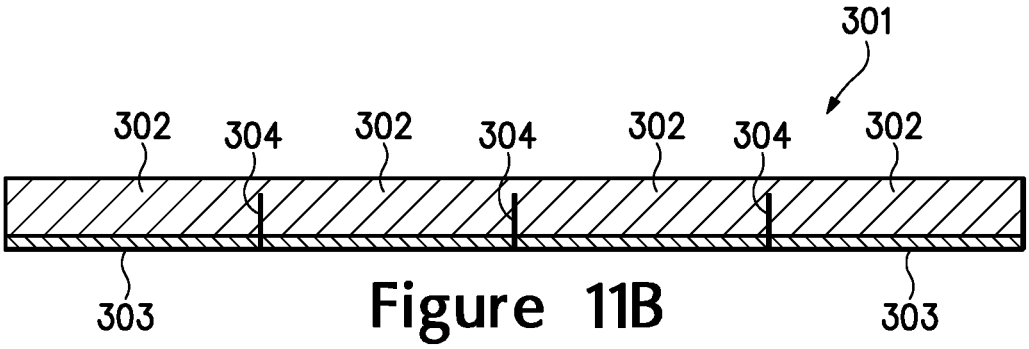
Figure 11C:
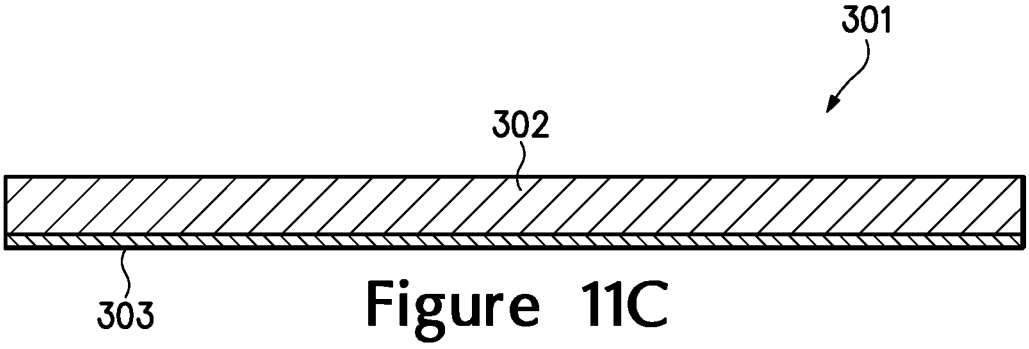
Figure 11D:
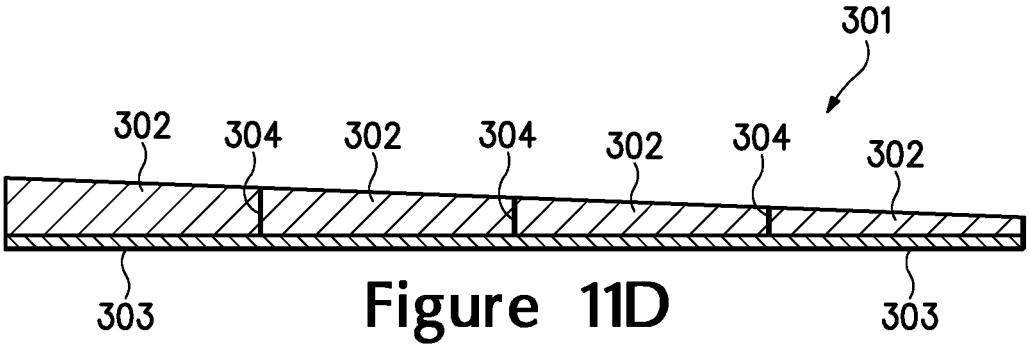

An advantage of incisions 304 is that the flex properties of attachment element 301 are enhanced. Referring to FIG. 10, attachment element 301 is shown in a flexed configuration, wherein incisions 304 separate to provide flex grooves that permit attachment element to curve or otherwise bend. As discussed in greater detail below, flexing permits attachment element 301 to conform with the shape of apparel 100 or apparel 200 in the location where attachment element 301 is secured to either apparel 100 or apparel 200. Although incisions 304 may extend entirely through the polymer foam material of portions 302, incisions 304 may also extend partially (e.g., at least fifty percent) through the polymer foam material, as depicted in FIG. 11A. Although incisions 304 may extend from an upper surface of portions 302 toward a lower surface, incisions 304 may also extend from the lower surface toward the upper surface and through fastening part 303, as depicted in FIG. 11B. Moreover, apertures 305 may also be absent from attachment element 301, as depicted in FIG. 11B. In other configurations, incisions 304 may be absent, as depicted in FIG. 11C, or portions 302 may impart a tapered configuration to attachment element 301.

Figure 12:
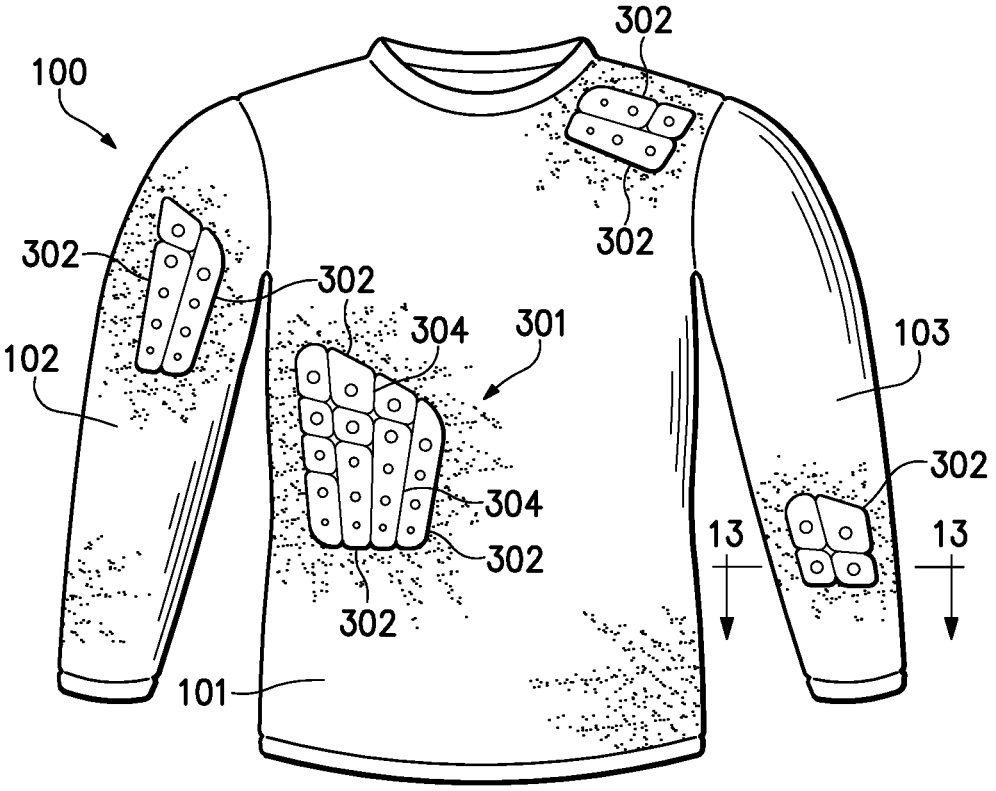
FIG. 12 is a front elevational view of the first article of apparel in combination with a pair of the first attachment element.
Figure 13:
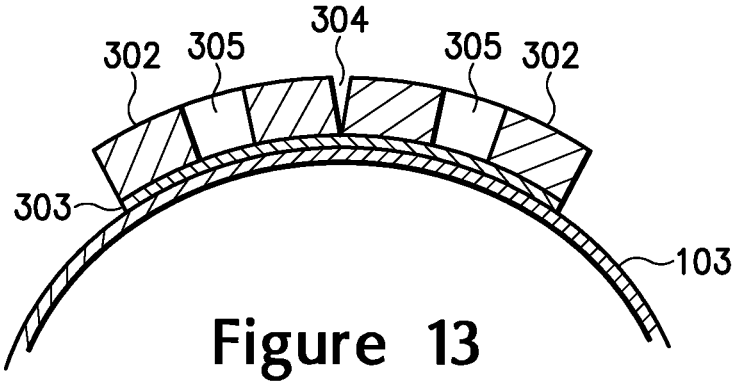
FIG. 13 is a cross-sectional view of the first article of apparel and a portion of the first attachment element, as defined by section line 13-13 in FIG. 12.

As with attachment elements 111-115, attachment element 301 may be secured to apparel 100, detached from apparel 100, and subsequently re-attached to apparel 100. Referring to FIG. 12, two of attachment element 301 are depicted as being secured to apparel 100. Whereas one of attachment elements 301 is in a complete state, the other of attachment elements 301 is separated into different sections and secured to different areas of apparel 100. In addition to providing flex, therefore, incisions 304 form separation lines where attachment element 301 may be divided into different sections. The wearer may, therefore, separate attachment element 301 into different sections in order to customize or otherwise tailor the shape and size of attachment element 301 to meet particular needs or purposes. Referring to FIG. 13, one section of attachment element 301 is shown as being attached to apparel 100, particularly arm region 103. An incision 304 between two portions 302 permits the section of attachment element 301 to flex to conform with the curvature in arm region 103.

The polymer foam material forming portions 302 attenuate compression forces (i.e., impart padding or cushioning) to provide impact protection to areas of the wearer where attachment element 301 or sections of attachment element 301 are located. For example, if the wearer has an injury to a shoulder area, attachment element 301 may be secured to apparel 100 and placed over the shoulder area to provide protection to the shoulder area during athletic activities. Similarly, if the wearer has an injury in the abdomen area, attachment element 301 may be located to protect to the abdomen area. Accordingly, attachment element 301 or sections of attachment element 301 may be utilized to impart protection to specific areas of the wearer.

Figure 15:
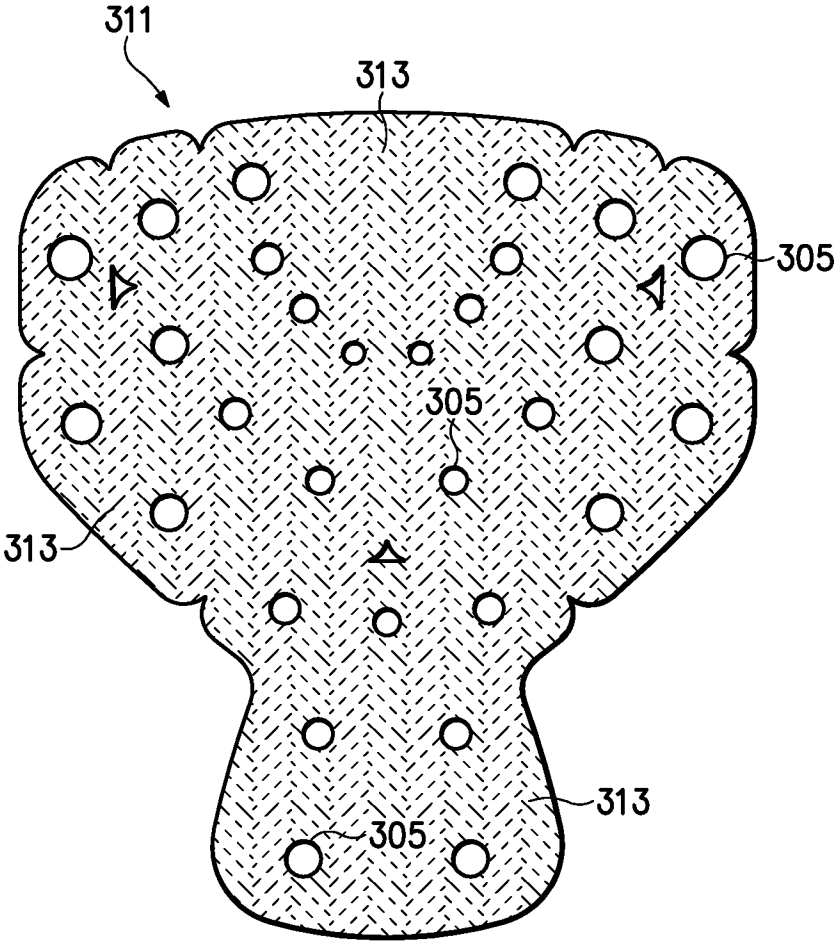
FIG. 15 is a bottom plan view of the second attachment element.
Figure 14:
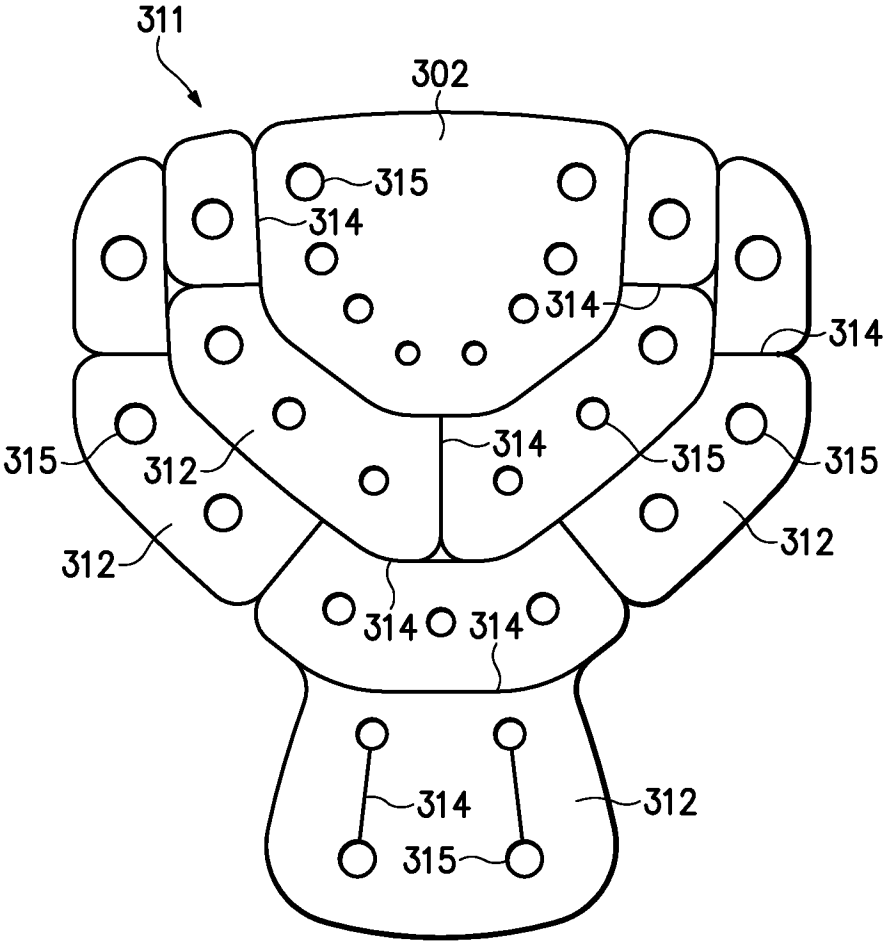
FIG. 14 is a top plan view of a second attachment element.

An example of another attachment element 311 is depicted in FIGS. 14 and 15 as including a plurality of portions 312 that are joined by a fastening part 313. Portions 312 may be formed from a polymer foam material, for example, and are separated from each other by a plurality of incisions 314. Each of portions 312 may also include at least one aperture 315. Fastening part 313 is secured to each of portions 312 and generally incorporates a part of the fastening system that secures attachment element 311 to apparel 100 or apparel 200. When, for example, the textile material forming apparel 100 or apparel 200 incorporates the loop part of the hook-and-loop fastening system, fastening part 313 may incorporate the hook part of the hook-and-loop fastening system. An advantage of incisions 314 is that the flex properties of attachment element 311 are enhanced.

Figure 16:
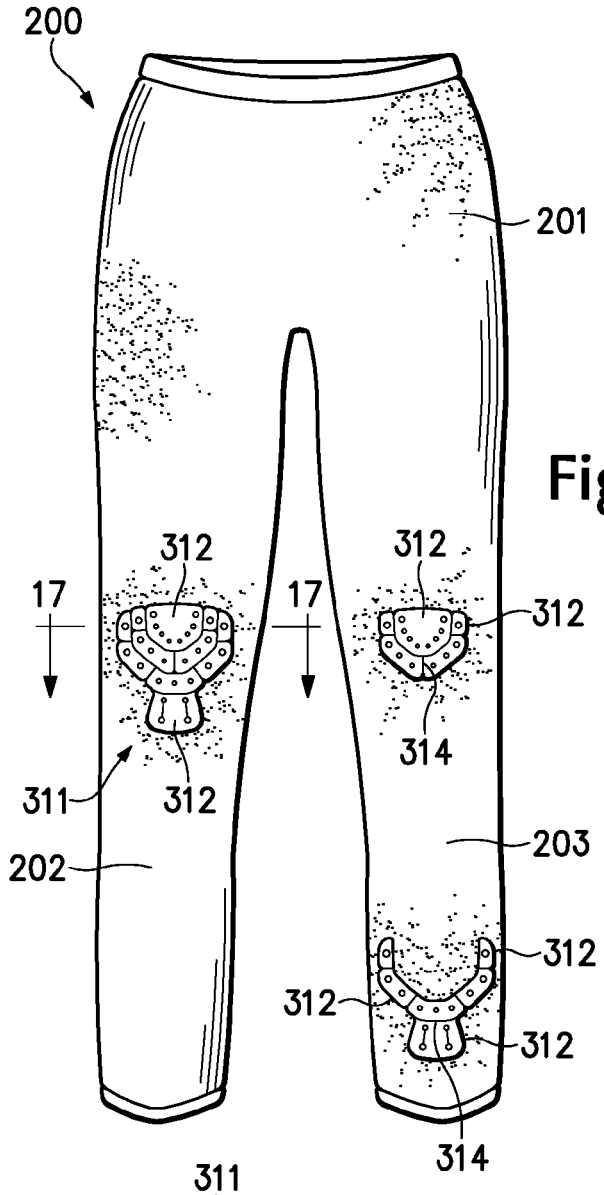
FIG. 16 is a front elevational view of the second article of apparel in combination with a pair of the second attachment element.
Figure 17:
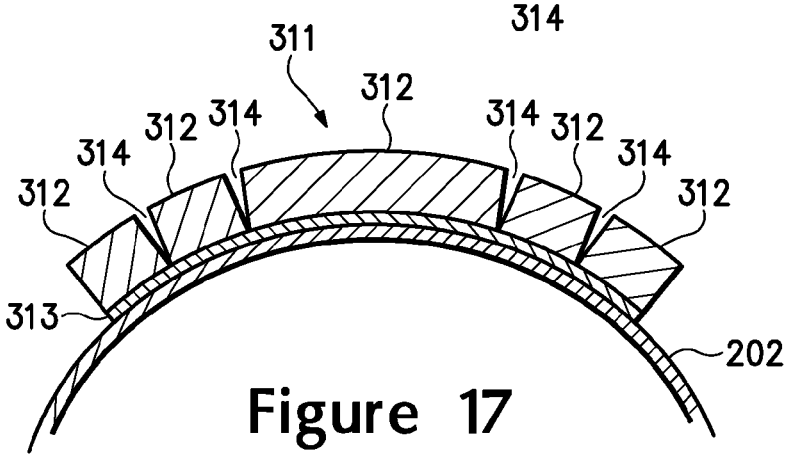
FIG. 17 is a cross-sectional view of the second article of apparel and the second attachment element, as defined by section line 17-17 in FIG. 16.

As with attachment elements 211-214, attachment element 311 may be secured to apparel 200, detached from apparel 200, and subsequently re-attached to apparel 200. Referring to FIG. 16, two of attachment element 311 are depicted as being secured to apparel 200. Whereas one of attachment elements 311 is in a complete state, the other of attachment elements 311 is separated into different sections and secured to different areas of apparel 200. In addition to providing flex, therefore, incisions 314 form separation lines where attachment element 311 may be divided into different sections. The wearer may, therefore, separate attachment element 311 into different sections in order to customize or otherwise tailor the shape and size of attachment element 311 to meet particular needs or purposes. Referring to FIG. 17, attachment element 311 is shown as being attached to apparel 200, particularly leg region 202. Incisions 314 permit attachment element 311 to flex to conform with the curvature in leg region 202. As with attachment element 301, attachment element 311 or sections of attachment element 311 may be utilized to impart protection to specific areas of the wearer.

Figure 18:
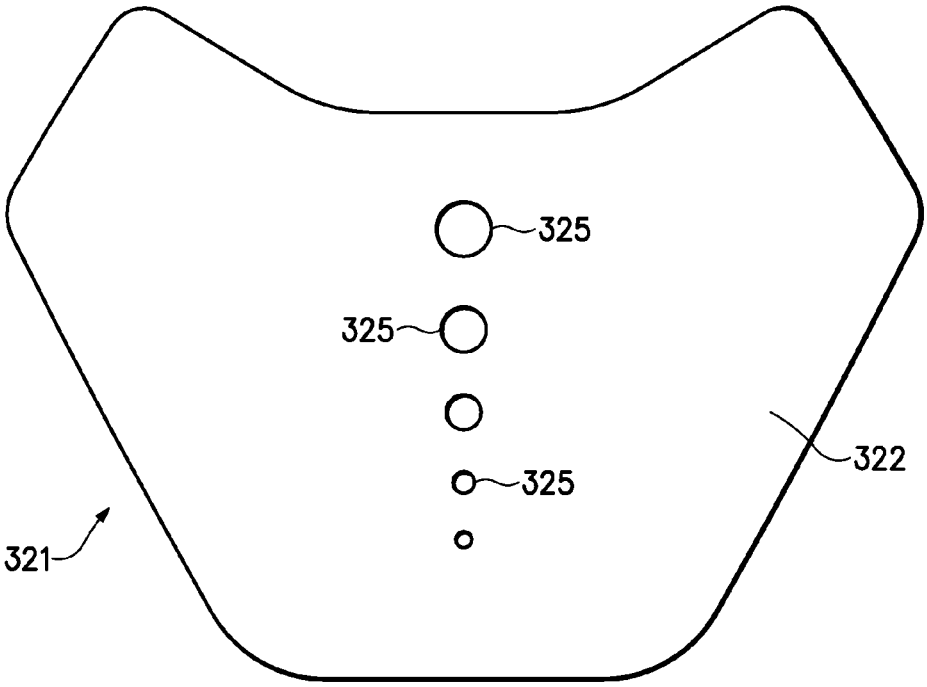
FIG. 18 is a top plan view of a third attachment element.
Figure 19:
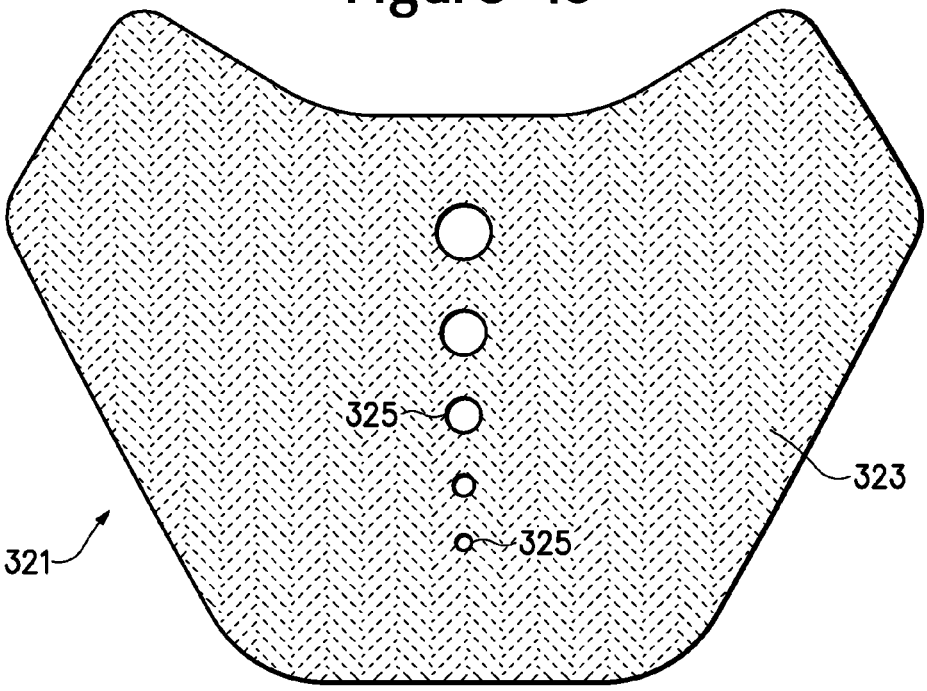
FIG. 19 is a bottom plan view of the third attachment element.

Another example of an attachment element 321 is depicted in FIGS. 18 and 19 as having a plate 322 and a fastening part 323. Whereas portions 302 and 312 were discussed as being formed from polymer foam materials, plate 322 may be formed from non-foamed polymer materials or rubber, for example. In some configurations, however, polymer foam materials may also be utilized for plate 322. Each of plate 322 and fastening part 323 may also define a plurality of apertures 325. As with the polymer foam materials of attachment elements 301 and 311, the plate configuration of attachment element 321 may be utilized to impart protection to specific areas of the wearer.

Figure 20:
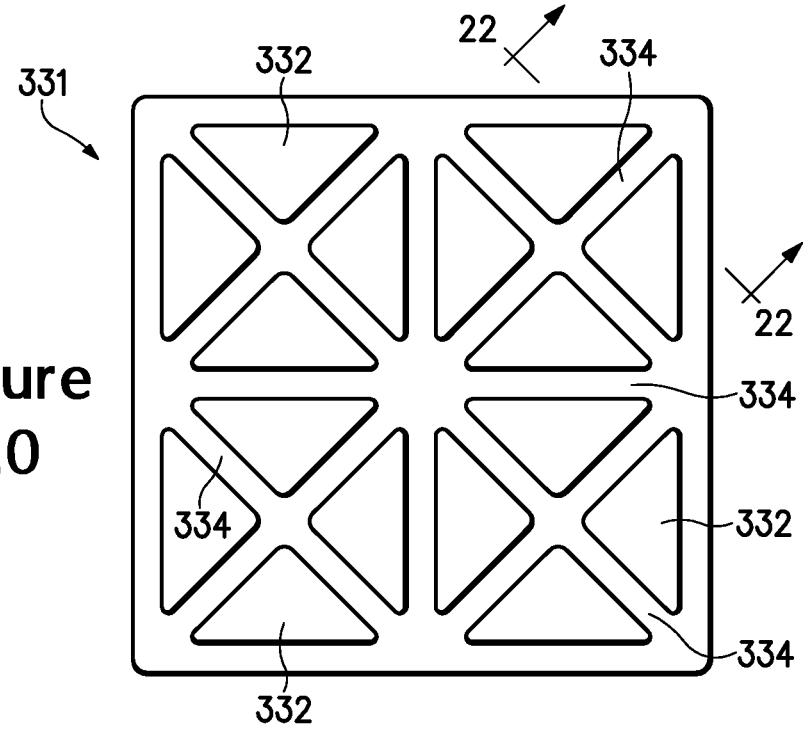
FIG. 20 is a top plan view of a fourth attachment element.
Figure 21:
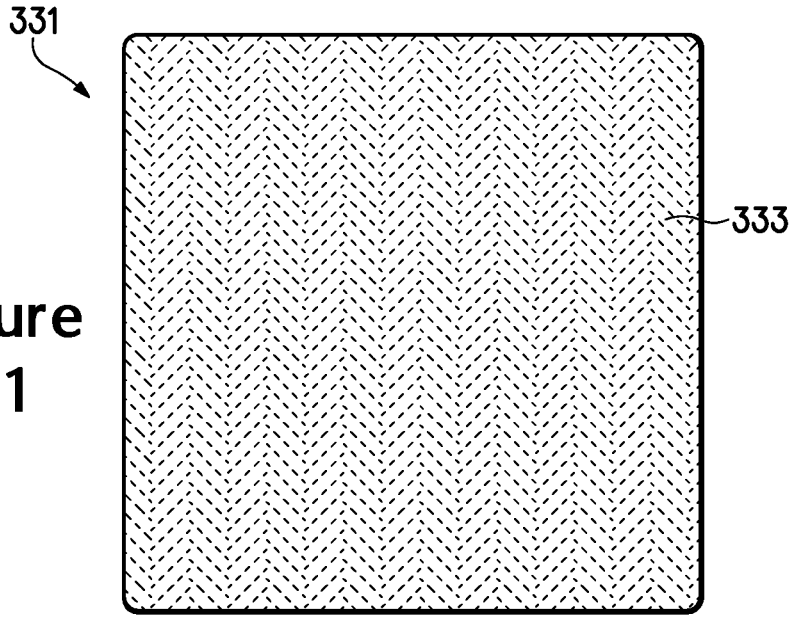
FIG. 21 is a bottom plan view of the fourth attachment element.
Figure 22:
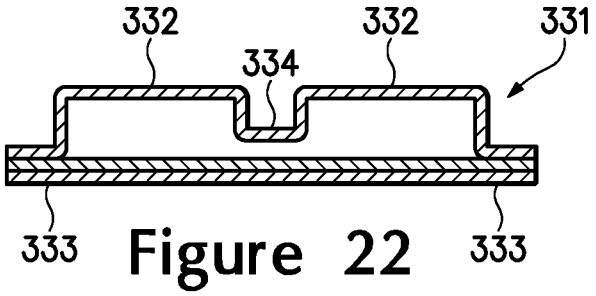
FIG. 22 is a cross-sectional view of the fourth attachment element, as defined by section line 22-22 in FIG. 20.

Yet another example of an attachment element 331 is depicted in FIGS. 20-22 as having a chamber portion 332 and a fastening part 333. Chamber portion 332 is formed from a polymer material that defines an interior void for receiving a fluid. Fastening part 333 is secured to chamber portion 332 and generally incorporates a part of the fastening system that secures attachment element 331 to apparel 100 or apparel 200. A plurality of indentations 334 are formed in a surface of chamber portion 332 to enhance the flexibility of attachment element 331. Either a gas or a liquid may be located within the void in chamber portion 332. In some configurations, chamber portion 332 may include an opening that permits the wearer to locate a liquid within chamber portion 332 or drain the liquid from chamber portion 332.

When chamber portion 332 includes a gas, such as a pressurized gas, attachment element 331 may be utilized to attenuate compression forces (i.e., impart padding or cushioning) to provide impact protection to areas of the wearer where attachment element 331 is located. That is, attachment element 331 may be utilized to impart protection to specific areas of the wearer. When a liquid is located within the void in chamber portion 332, the liquid may be utilized to impart heating or cooling to areas of the wearer where attachment element 331 is located. More particularly, attachment element 331 and the liquid within attachment element 331 may be heated or cooled. Once located adjacent to a specific area of the wearer, attachment element 331 and the liquid within attachment element 331 may impart heat to or draw heat away from the area of the wearer.

Figure 23:
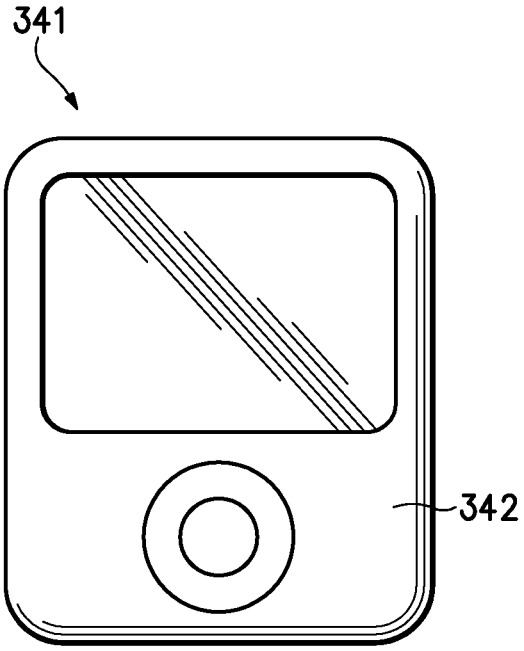
FIG. 23 is a top plan view of a fifth attachment element.
Figure 24:
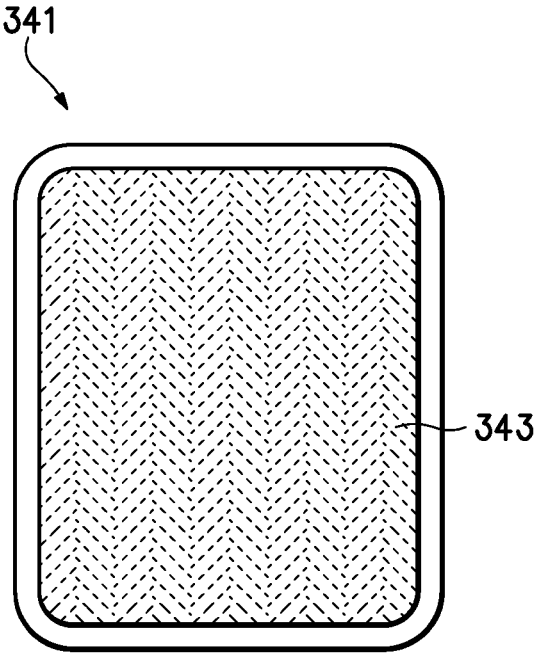
FIG. 24 is a bottom plan view of the fifth attachment element.

A further example of an attachment element 341 is depicted in FIGS. 23 and 24 as having including an electronic device 342. A fastening part 343 is secured to a back surface of device 342 and generally incorporates a part of the fastening system that secures attachment element 341 to apparel 100 or apparel 200. As examples, electronic device 342 may be any of a mobile phone, portable music player, timing device, locator beacon, global positioning system, or mobile computing device.

Second Shirt-Type Garment Configuration

Figure 25:
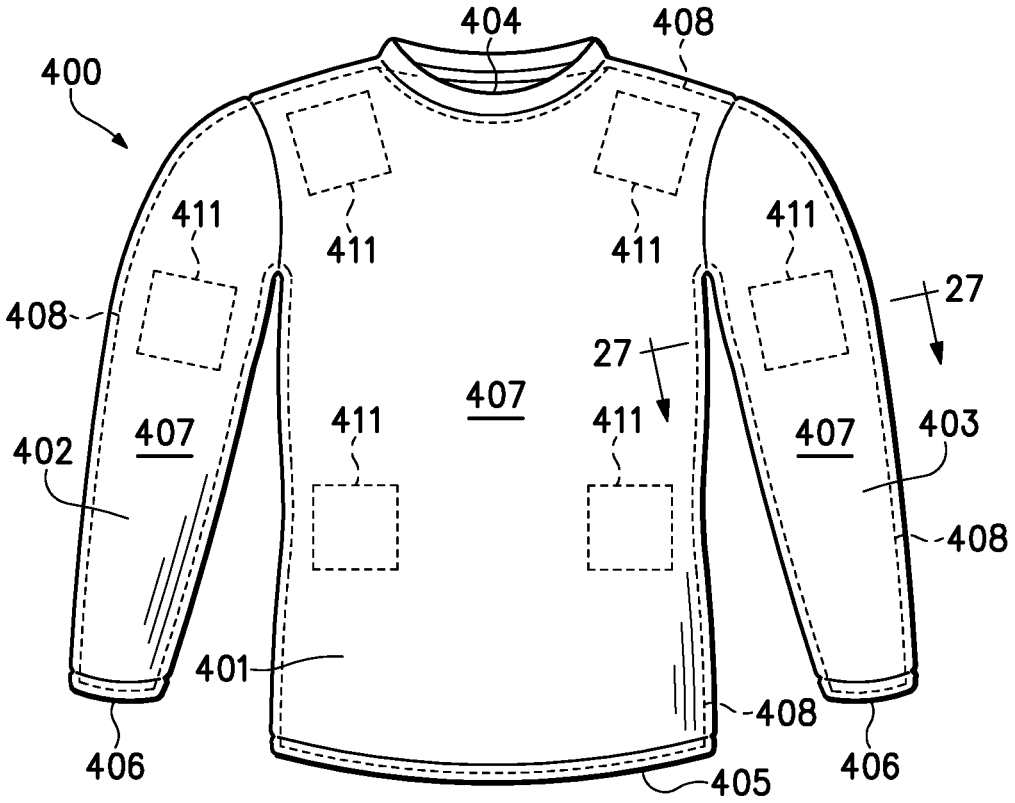
FIG. 25 is a front elevational view of a third article of apparel incorporating a plurality of attachment elements.

An article of apparel 400 having the configuration of a shirt-type garment is depicted in FIG. 25. Apparel 400 includes a torso region 401 and a pair of arm regions 402 and 403 that extend outward from torso region 401. Torso region 401 corresponds with a torso of a wearer and covers at least a portion of the torso when worn. An upper area of torso region 401 defines a neck opening 404 through which the neck and head of the wearer protrude when apparel 400 is worn. Similarly, a lower area of torso region 401 defines a waist opening 405 through which the waist or pelvic area of the wearer protrudes when apparel 400 is worn. Arm region 402 corresponds with a right arm of the wearer and covers at least a portion of the right arm, and arm region 403 corresponds with a left arm of the wearer and covers at least a portion of the left arm. Each of arm regions 402 and 403 define a wrist opening 406 through which a hand and wrist of the wearer protrude when apparel 400 is worn.

Apparel 400 exhibits a two-layer configuration having an outer layer 407 and an adjacent inner layer 408 that extend through each of regions 401-403. Whereas outer layer 407 forms an outer portion of apparel 400, inner layer 408 forms an inner portion that may contact the wearer when apparel 400 is worn. A variety of attachment elements 411 are secured between layers 407 and 408. More particularly, attachment elements 411 are located between layers 407 and 408 in torso region 401 and in each of arm regions 402 and 403. Attachment elements 411 may be any of foam members, fluid-filled chambers (e.g., gas-filled or liquid-filled), plates, or electronic devices. Although depicted as having a generally square aspect for purposes of example, the shapes, sizes, and thicknesses of attachment elements 411 may vary significantly.

Figure 26:
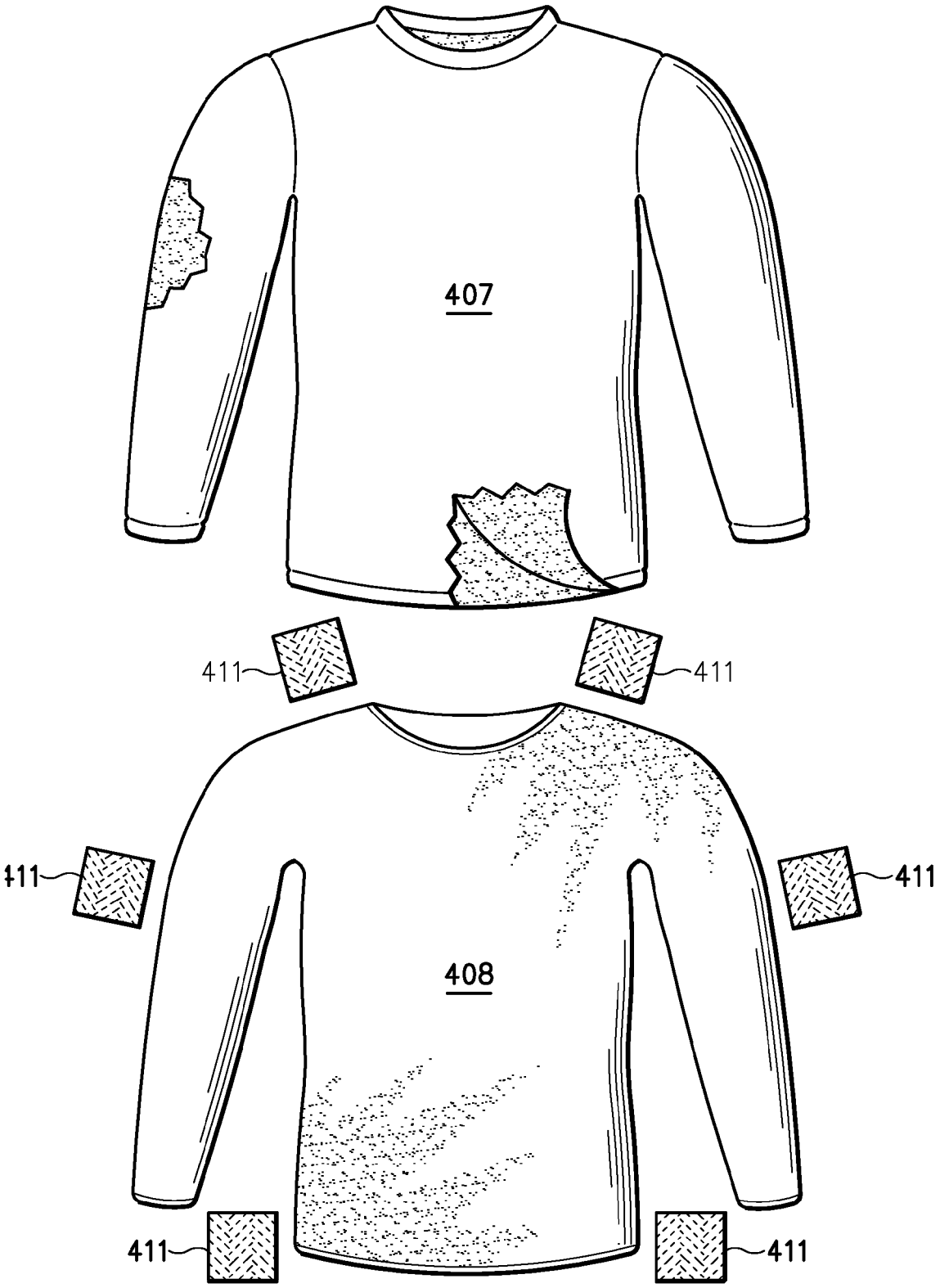
FIG. 26 is an exploded front elevational view of the third article of apparel and the attachment elements.
Figure 27:
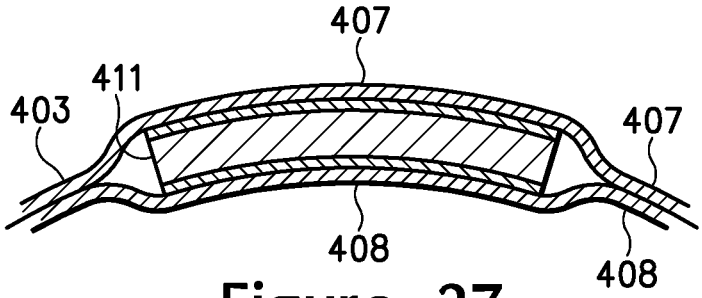
FIG. 27 is a cross-sectional view of the third article of apparel and one of the attachment elements, as defined by section line 27-27 in FIG. 25.

Apparel 400 and attachment elements 411 each incorporate portions of a fastening system that is utilized to secure attachment elements 411 between layers 407 and 408. In addition to attaching or otherwise securing attachment elements 411 to apparel 400, the fastening system permits attachment elements 411 to be detached or otherwise separated from apparel 400. As with apparel 100 and 200, a variety of fastening systems may be utilized, including hook-and-loop fastening systems, magnetic fastening systems, adhesive fastening systems, and button-type fastening systems, for example. For purposes of reference, portions of apparel 400 and attachment elements 411 incorporating the fastening system or a part of the fastening system are depicted as having a stippled or otherwise textured configuration in the figures. More particularly, and with reference to FIG. 26, (a) surfaces of layers 407 and 408 that contact each other and (b) opposite surfaces of attachment elements 411 each include a part of the fastening system. That is, (a) an inwardly-facing surface of outer layer 407 includes a part of the fastening system, (b) an outwardly-facing surface of inner layer 408 includes a part of the fastening system, and (c) both surfaces of each attachment element 411 include a part of the fastening system. Accordingly, when one of attachment elements 411 is located between layers 407 and 408, as depicted in FIG. 27, parts of the fastening system associated with facing surfaces of layers 407 and 408 each join with parts of the fastening system located on opposite sides of the attachment element 411.

Whereas only one surface of attachment elements 111-115, 211-214, 301, 311, 321, 331, and 341, incorporates a part of a fastening system that joins with an article of apparel, both surfaces of attachment elements 411 incorporate a part of a fastening system and join with apparel 400 (i.e., layers 407 and 408). Advantages to this configuration are that attachment elements 411 may be positively-secured to apparel 400 and are less likely to be inadvertently-removed from apparel 400. More particularly, securing both sides of attachment elements 411 to apparel 400 and between layers 407 and 408 reduces the probability that attachment elements 411 may be stripped from apparel 400 or will fall off of apparel 400. In configurations where attachment elements 411 incorporate a liquid-filled chamber, each of attachment elements 411 may be relatively heavy and may benefit from being secured on both surfaces. Accordingly, the two-layer configuration of apparel 400 imparts a configuration wherein attachment elements 411 are positively-secured and less likely to be inadvertently-removed from apparel 400.

For purposes of the following discussion, assume that the fastening system incorporated into apparel 400 and attachment elements 411 is a hook-and-loop fastening system. The hook part and the loop part of the hook-and-loop fastening system may be associated with various portions of apparel 400 and attachment elements 411. As examples, (a) each of layers 407 and 408 may incorporate the loop part, and the opposite surfaces of attachment elements 411 may incorporate the hook part; (b) each of layers 407 and 408 may incorporate the hook part, and the opposite surfaces of attachment elements 411 may incorporate the loop part; (c) layer 407 may incorporate the hook part, layer 408 may incorporate the loop part, and the opposite surfaces of attachment elements 411 may incorporate the hook part and the loop part; or (d) layer 407 may incorporate the loop part, layer 408 may incorporate the hook part, and the opposite surfaces of attachment elements 411 may incorporate the hook part and the loop part. Although any of the configurations discussed above may be utilized, an advantage to forming apparel 400 such that each of layers 407 and 408 incorporate the loop part or the hook part (i.e., examples (a) or (b)) is that layers 407 and 408 exhibit less of a tendency to join with each other.

Any of the materials discussed above for apparel 100 may be utilized in manufacturing apparel 400. When apparel 400 and attachment elements 411 incorporate a hook-and-loop fastening system, elements of either a hook part or a loop part may be secured to facing surfaces of layers 407 and 408, as well as opposite surfaces of attachment elements 411. Alternatively, the hook part or the loop part of the hook-and-loop fastening system may be knitted as an integral part of the textile material forming each of layers 407 and 408. In some configurations, the textile materials may include coatings that form a breathable and water-resistant barrier, or polymer sheets may be utilized in place of textile materials. Each of layers 407 and 408 may also be formed from laminated or otherwise layered materials that include two or more layers of textile materials, polymer sheets, or combinations of textile materials and polymer sheets.

Apparel 400 is depicted as having the configuration of a shirt-type garment, particularly a long-sleeved shirt. While apparel 400 may be intended to have a loose-fitting configuration, apparel 400 may also be intended for use as a compression garment. As discussed above, compression garments or other garments intended as base layers (a) exhibit a relatively tight fit that lays adjacent to the skin of the wearer and (b) stretch to conform with the contours of the wearer. While the textile materials forming compression garments may have one-directional stretch of, for example, more than ten percent prior to tensile failure, the textile materials forming other compression garments have two-directional stretch of at least thirty percent prior to tensile failure. Accordingly, when apparel 400 is formed to have a relatively tight fit and to stretch to conform with the contours of the wearer, the textile materials forming apparel 400 (i.e., layers 407 and 408) may have two-directional stretch of at least thirty percent prior to tensile failure. In some configurations, outer layer 407 may impart a loose-fitting configuration, whereas inner layer 408 may provide a relatively tight and stretchable fit. In other configurations, inner layer 408 may impart a loose-fitting configuration, whereas outer layer 407 may provide a relatively tight and stretchable fit.

Figure 28A:
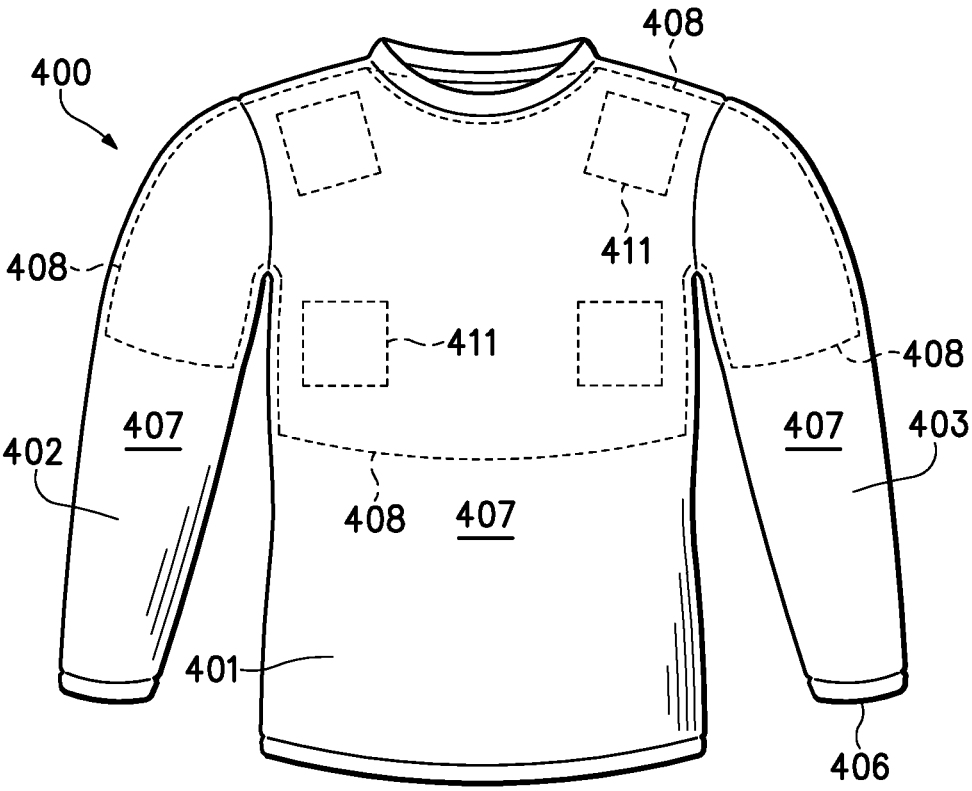
FIGS. 28A-28D are front elevational views of further configurations of the third article of apparel and the attachment elements.
Figure 28B:
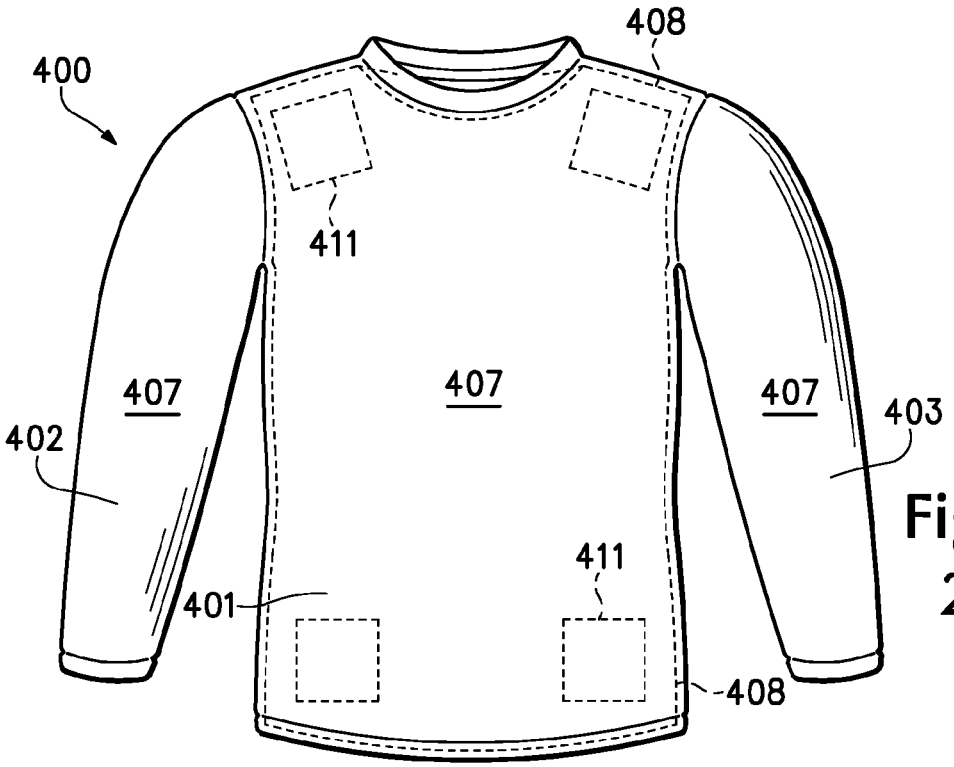
Figure 28C:
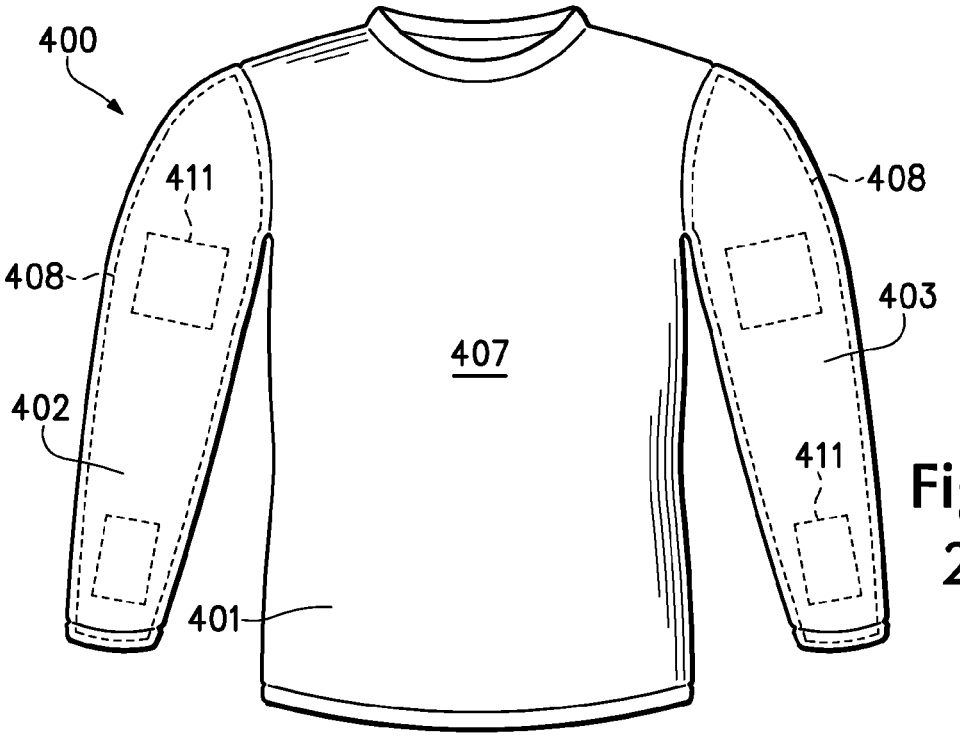
Figure 28D:
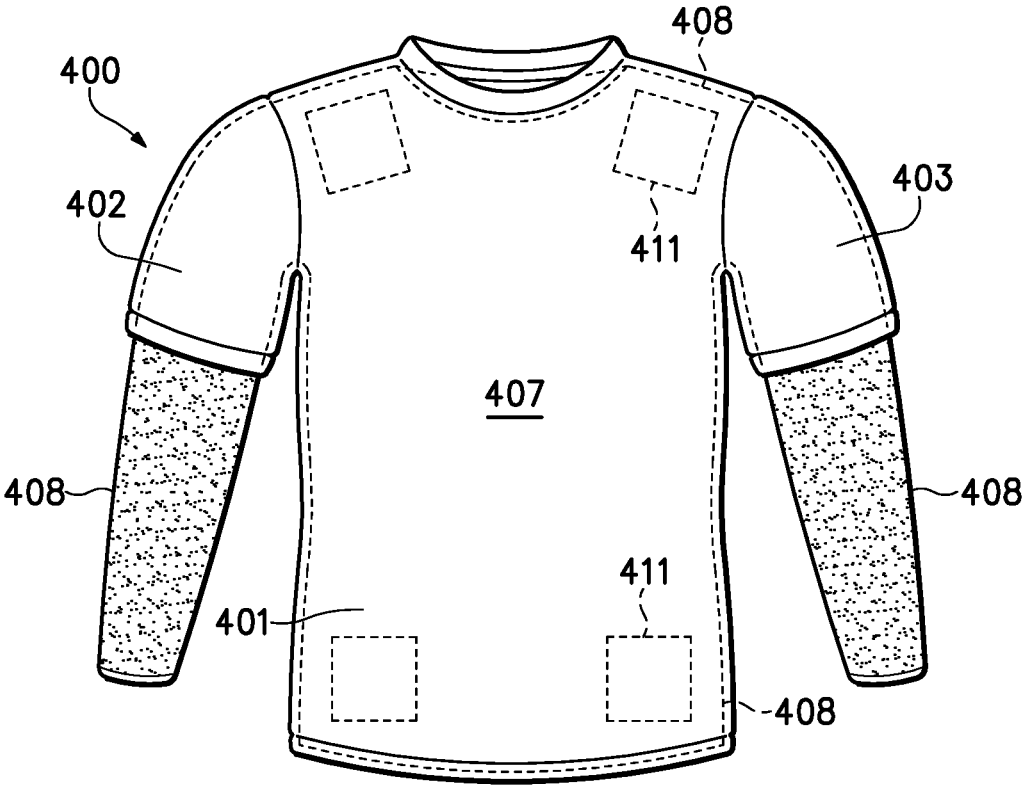

Each of outer layer 407 and inner layer 408 extend through substantially all of regions 401-403, which permits attachment elements 411 to be secured to any area of regions 401-403. In some configurations, only a portion of layers 407 and 408 may incorporate a part of the fastening system. For example, although layers 407 and 408 may extend through substantially all of regions 401-403, the fastening system may be absent from torso region 401 or may alternately be absent from arm regions 402 and 403. In other configurations, layers 407 and 408 may cover different areas of the wearer. As an example, a configuration wherein inner layer 408 is limited to an upper area of torso region 401 and upper areas of arm regions 402 and 403 is depicted in FIG. 28A. In this configuration, the fastening system is present in at least fifty percent of apparel 400. Inner layer 408 may also be absent from arm regions 402 and 403, as depicted in FIG. 28B. A configuration wherein inner layer 408 is only located in arm regions 402 and 403 is illustrated in FIG. 28C. In this configuration, the fastening system is present in at least twenty percent of apparel 400. Moreover, FIG. 28D depicts a configuration wherein (a)

outer layer 407 is absent in lower portions of arm regions 402 and 403, whereas inner layer 408 extends through each or regions 401-403. Although apparel 400 is depicted as having the configuration of a long-sleeved shirt in each of FIGS. 25-28D, concepts associated with apparel 400 may also incorporated into other shirt-type garments, including a short-sleeved shirt, a tank top, undershirt, jacket, or coat. Accordingly, the relative areas covered by the fastening system and layers 407 and 408 may vary significantly.

Second Pants-Type Garment Configuration

Figure 29:
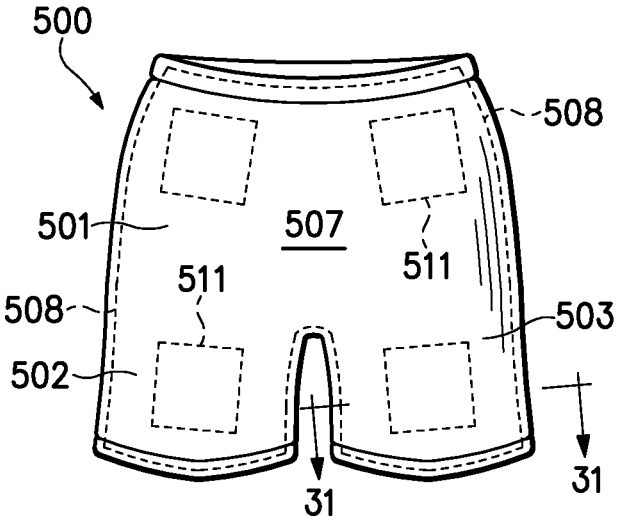
FIG. 29 is a front elevational view of a fourth article of apparel incorporating a plurality of attachment elements.
Figure 30:
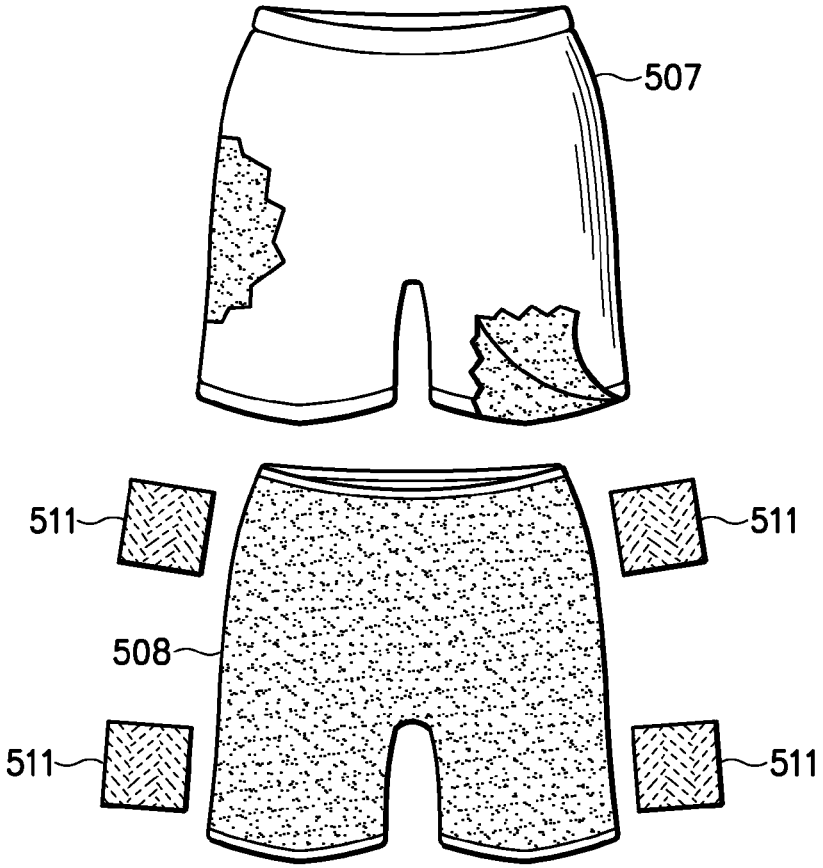
FIG. 30 is an exploded front elevational view of the fourth article of apparel and the attachment elements.
Figure 31:
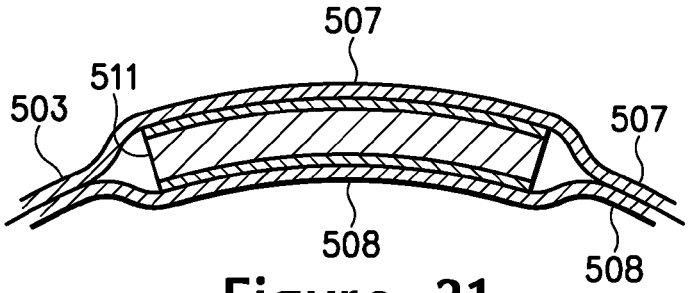
FIG. 31 is a cross-sectional view of the fourth article of apparel and one of the attachment elements, as defined by section line 31-31 in FIG. 29.

Various concepts associated with apparel 400 may also be incorporated into other types of apparel. An article of apparel 500 having the configuration of a pants-type garment is depicted in FIGS. 29 and 30. Apparel 500 includes a pelvic region 501 and a pair of leg regions 502 and 503 that extend outward from pelvic region 501. As with apparel 400, apparel 500 has a two-layer configuration that includes an outer layer 507 and an adjacent inner layer 508 that extend through each of regions 501-503. Whereas outer layer 507 forms an outer portion of apparel 500, inner layer 508 forms an inner portion that may contact the wearer when apparel 500 is worn. Any of the materials discussed above may be utilized in manufacturing apparel 500. A variety of attachment elements 511 are secured between layers 507 and 508, as depicted in FIG. 31. Attachment elements 511 may be any of foam members, fluid-filled chambers (e.g., gas-filled or liquid-filled), plates, or electronic devices. Although depicted as having a generally square aspect for purposes of example, the shapes, sizes, and thicknesses of attachment elements 511 may vary significantly.

Apparel 500 and attachment elements 511 each incorporate portions of a fastening system that is utilized to secure attachment elements 511 between layers 507 and 508. In addition to attaching or otherwise securing attachment elements 511 to apparel 500, the fastening system permits attachment elements 511 to be detached or otherwise separated from apparel 500. A variety of fastening systems may be utilized, including hook-and-loop fastening systems, magnetic fastening systems, adhesive fastening systems, and button-type fastening systems, for example. When incorporating the hook-and-loop fastening system, an advantage to forming apparel 500 such that each of layers 507 and 508 incorporate the loop part or the hook part is that layers 507 and 508 exhibit less of a tendency to join with each other. For purposes of reference, portions of apparel 500 and attachment elements 511 incorporating the fastening system or a part of the fastening system are depicted as having a stippled or otherwise textured configuration in the figures.

While apparel 500 may be intended to have a loose-fitting configuration, apparel 500 may also be intended for use as a compression garment. As discussed above, compression garments or other garments intended as base layers (a) exhibit a relatively tight fit that lays adjacent to the skin of the wearer and (b) stretch to conform with the contours of the wearer. While the textile materials forming compression garments may have one-directional stretch of, for example, more than ten percent prior to tensile failure, the textile materials forming other compression garments have two-directional stretch of at least thirty percent prior to tensile failure. Accordingly, when apparel 500 is formed to have a relatively tight fit and to stretch to conform with the contours of the wearer, the textile materials forming apparel 500 (i.e., layers 507 and 508) may have two-directional stretch of at least thirty percent prior to tensile failure. In some configurations, outer layer 507 may impart a loose-fitting configuration, whereas inner layer 508 may provide a relatively tight and stretchable fit. In other configurations, inner layer 508 may impart a loose-fitting configuration, whereas outer layer 507 may provide a relatively tight and stretchable fit.

Figure 32A:
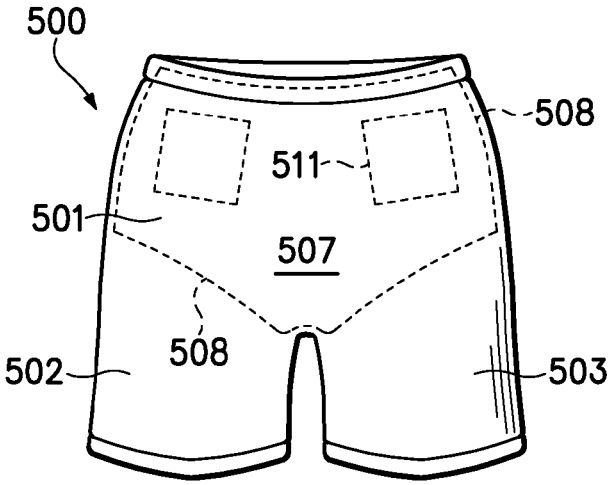
FIGS. 32A-32D are front elevational views of further configurations of the fourth article of apparel and the attachment elements.
Figure 32B:
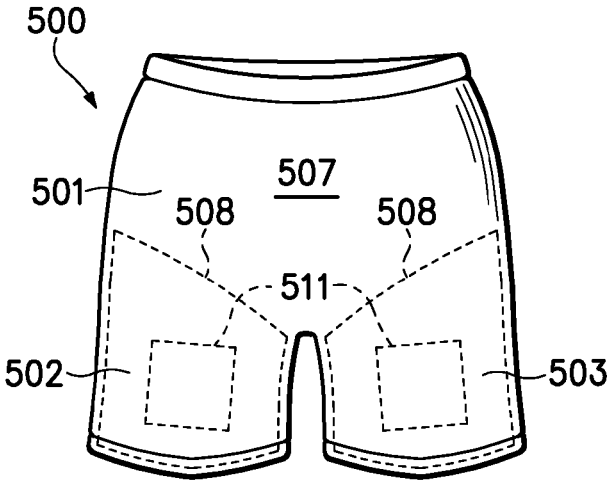
Figure 32C:
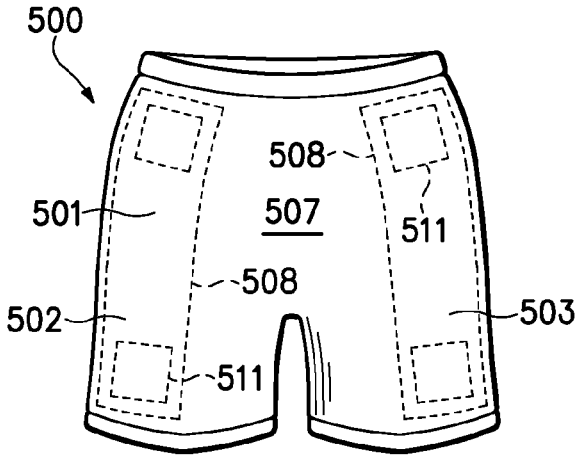
Figure 32D:
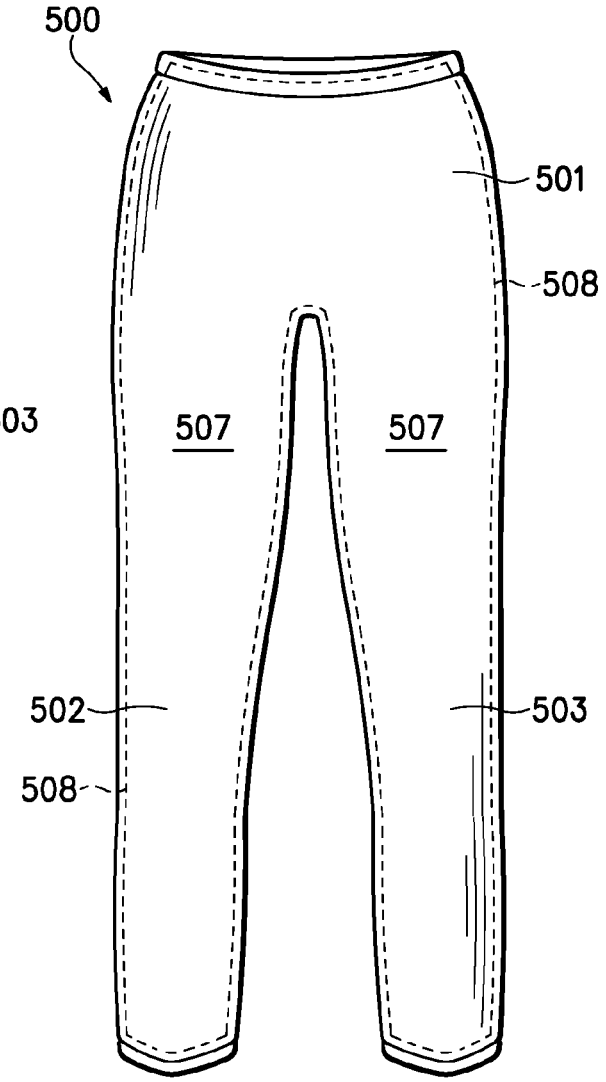

Each of outer layer 507 and inner layer 508 extend through substantially all of regions 501-503, which permits attachment elements 511 to be secured to any area of regions 501-503. In some configurations, only a portion of layers 507 and 508 may incorporate a part of the fastening system. For example, although layers 507 and 508 may extend through substantially all of regions 501-503, the fastening system may be absent from pelvic region 501 or may alternately be absent from leg regions 502 and 503. In other configurations, layers 507 and 508 may cover different areas of the wearer. As an example, a configuration wherein inner layer 508 is limited to pelvic region 501 is depicted in FIG. 32A. In this configuration, the fastening system is present in at least fifty percent of apparel 400. Inner layer 508 may also be absent from pelvic region 501, as depicted in FIG. 32B. A configuration wherein inner layer 508 is only located in side areas of apparel 500 is illustrated in FIG. 32C. In this configuration, the fastening system is present in at least twenty percent of apparel 400. Although apparel 500 is depicted as having the configuration of a pair of shorts in each of FIGS. 29-32C, concepts associated with apparel 500 may also incorporated into a pair of pants, as in FIG. 32D, or into briefs, jeans, and underwear. Accordingly, the relative areas covered by the fastening system and layers 507 and 508 may vary significantly.

Further Attachment Element Configurations

Figure 34:
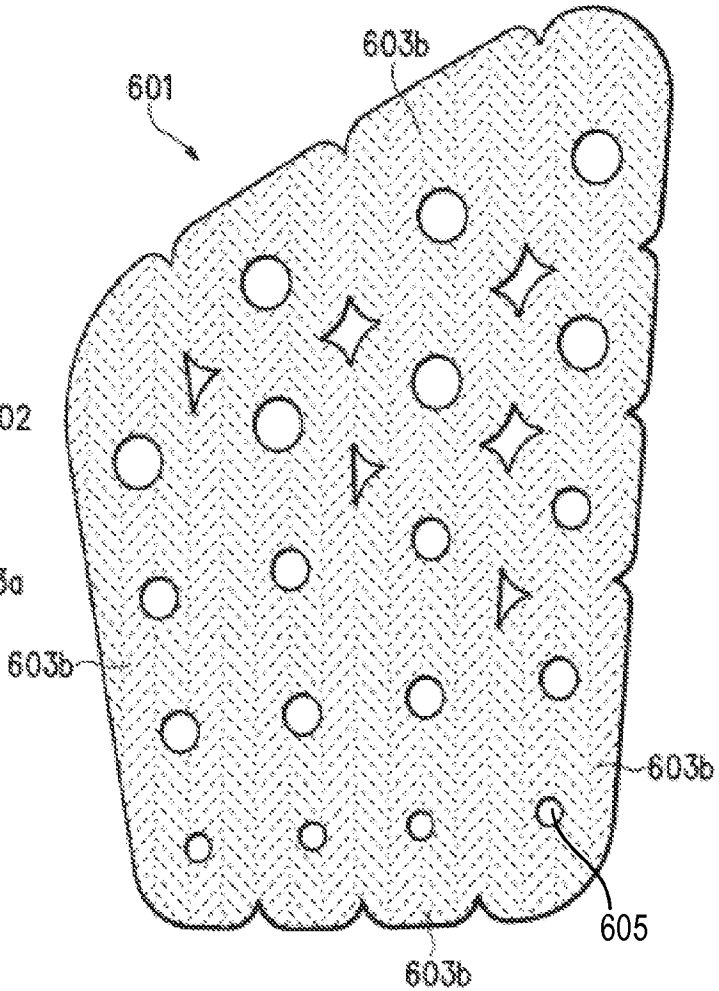
FIG. 34 is a bottom plan view of the sixth attachment element.
Figure 33:
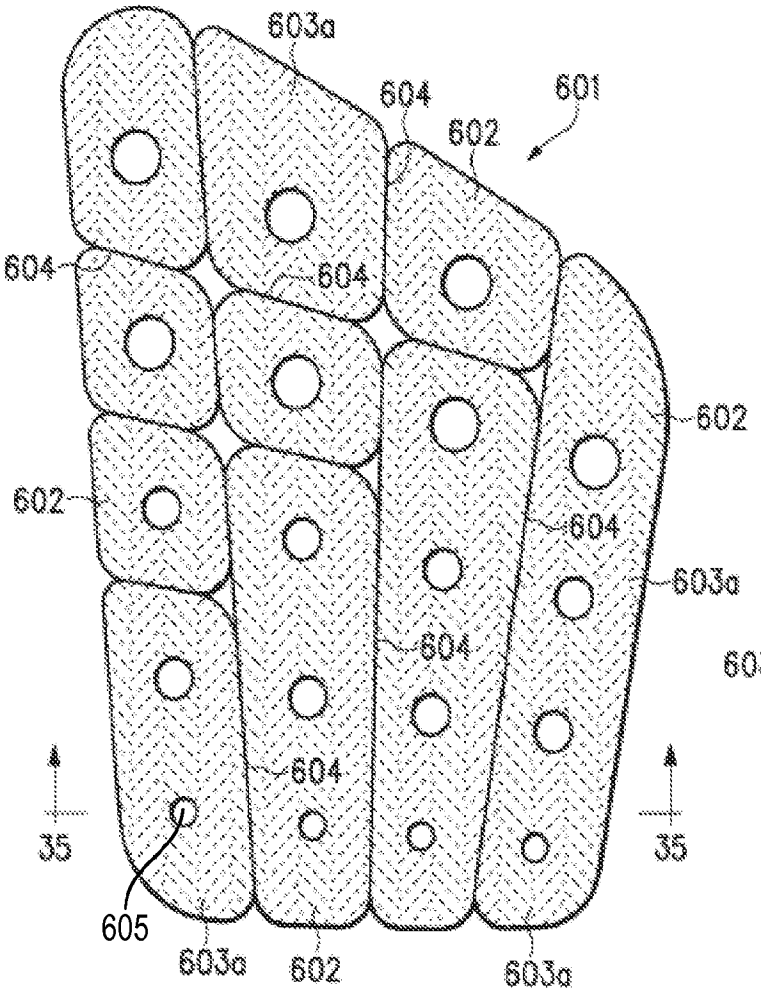
FIG. 33 is a top plan view of a sixth attachment element.
Figure 35:
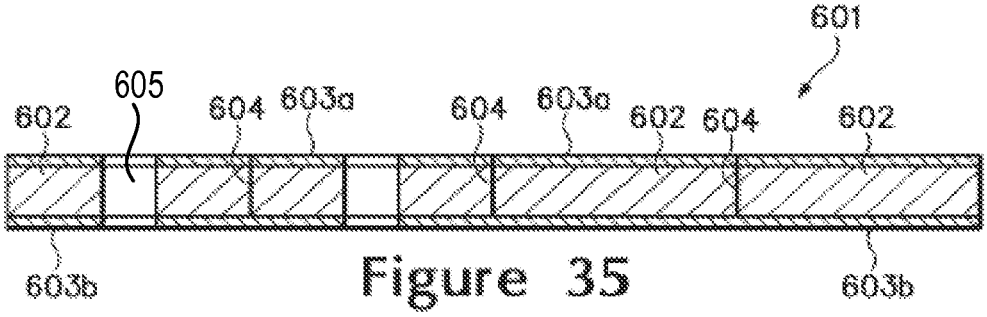
FIG. 35 is a cross-sectional view of the sixth attachment element, as defined by section line 35-35 in FIG. 33.
Figure 36:
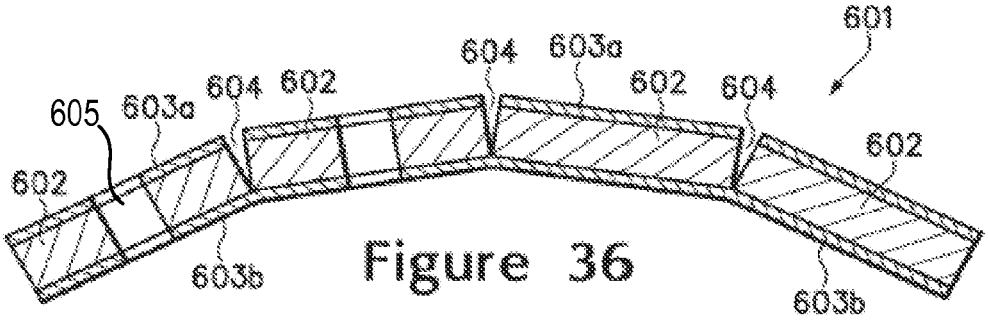
FIG. 36 is a cross-sectional view corresponding with FIG. 35 and depicting the sixth attachment element in a flexed configuration.

Attachment elements 411 and 511 may exhibit a variety of different configurations, depending upon the activities, particular needs, and preferences of a wearer. An example of an attachment element 601 is depicted in FIGS. 33-35 as including a plurality of portions 602 that are separated from each other by a plurality of incisions 604. Each of portions 602 may also include at least one through aperture 605, which enhances breathability and reduces the overall weight of attachment element 601. A pair of fastening parts 603*a* and 603*b* are secured to opposite sides of portions 602. Whereas incisions 604 extend through fastening part 603*a*, fastening part 603*b* extends across incisions 604. Fastening parts 603*a* and 603*b* incorporate a part of the fastening system that secures attachment element 601 to apparel 400 or apparel 500. That is, fastening parts 603*a* and 603*b* are located on opposite surfaces of portions 602 and join with facing surfaces of layers 407 and 408 or 507 and 508. When, for example, the textile material forming apparel 400 or apparel 500 incorporates the loop part of the hook-and-loop fastening system, fastening parts 603*a* and 603*b* may incorporate the hook part of the hook-and-loop fastening system. An advantage of incisions 604 is that the flex properties of attachment element 601 are enhanced, as depicted in FIG. 36. In general, therefore, attachment element 601 is similar to attachment element 301, but includes an additional part of the fastening system on an opposite surface.

Figure 37:
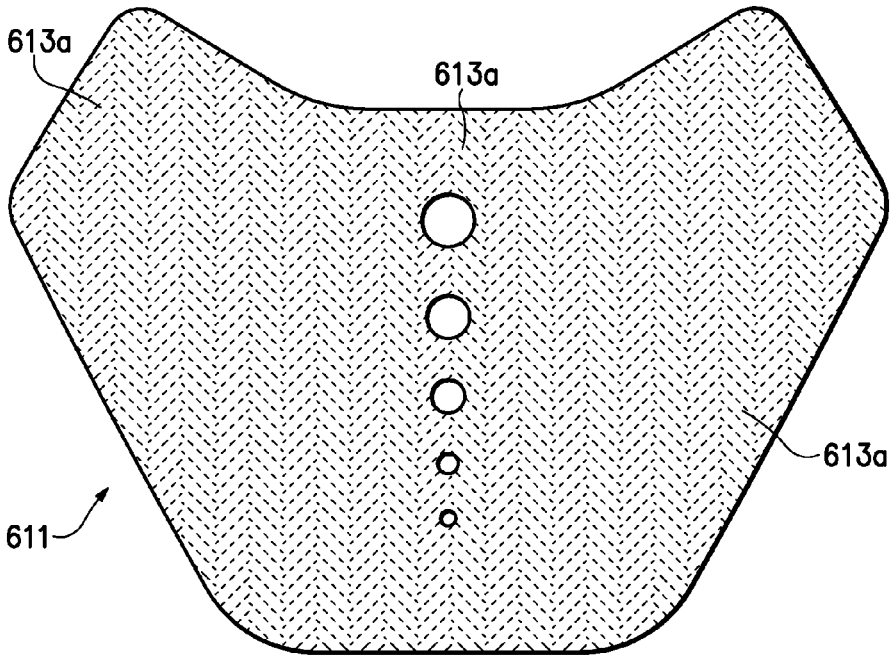
FIG. 37 is a top plan view of a seventh attachment element.
Figure 38:
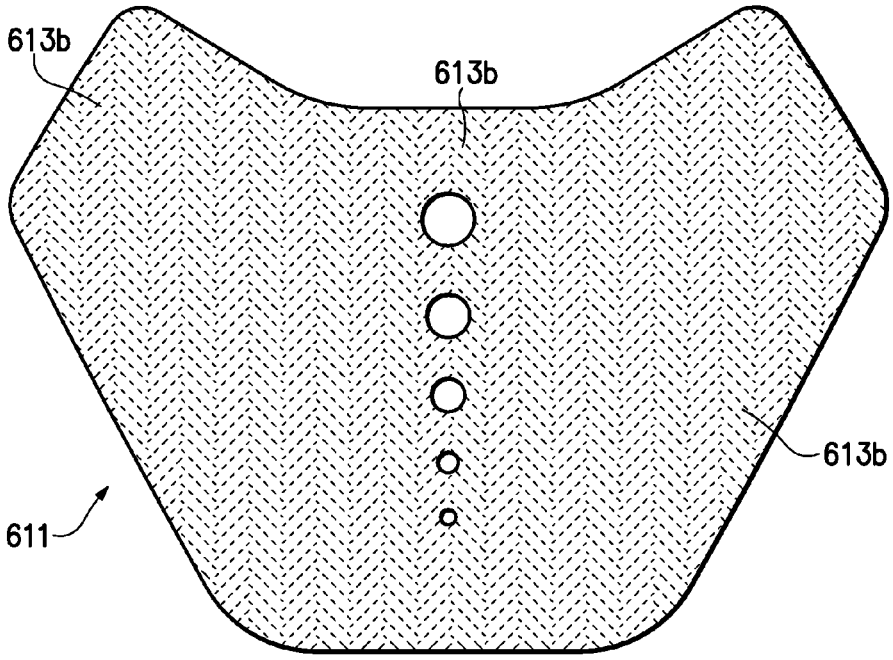
FIG. 38 is a bottom plan view of the seventh attachment element.

Another example of an attachment element 611 is depicted in FIGS. 37 and 38 as having a plate (not depicted) that is located between two fastening parts 613*a* and 613*b*. Fastening parts 613*a* and 613*b* are located on opposite surfaces of the plate and join with facing surfaces of layers 407 and 408 or 507 and 508. In general, therefore, attachment element 611 is similar to attachment element 321, but includes an additional part of the fastening system on an opposite surface.

Figure 39:
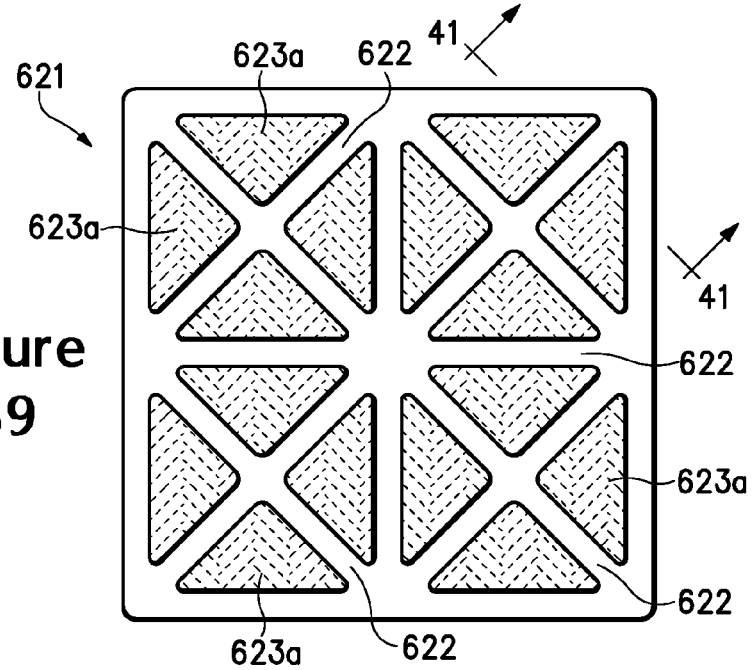
FIG. 39 is a top plan view of an eighth attachment element.
Figure 40:
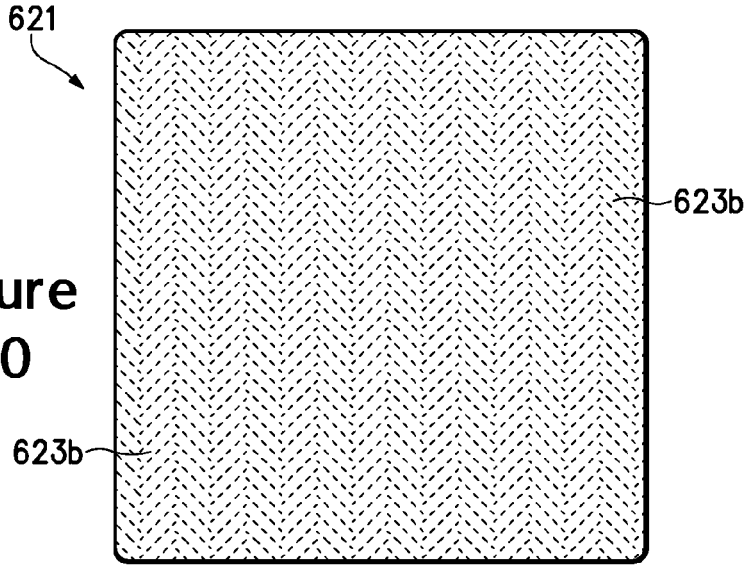
FIG. 40 is a bottom plan view of the eighth attachment element.
Figure 41:
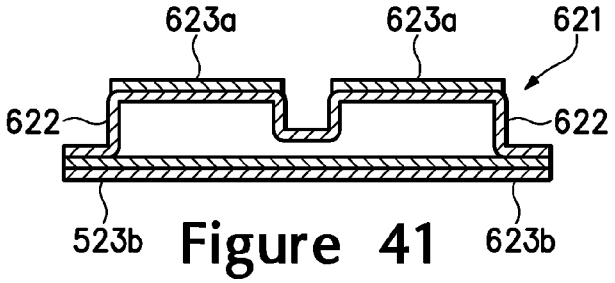
FIG. 41 is a cross-sectional view of the eighth attachment element, as defined by section line 41-41 in FIG. 39.

Yet another example of an attachment element 621 is depicted in FIGS. 39-41 as having a chamber portion 622 located between two fastening parts 623*a* and 623*b*. Chamber portion 622 is formed from a polymer material that defines an interior void for receiving a fluid. Either a gas or a liquid may be located within the void in chamber portion 622. In some configurations, chamber portion 622 may include an opening that permits the wearer to locate a liquid within chamber portion 622 or drain the liquid from chamber portion 622. Fastening parts 623*a* and 623*b* are located on opposite surfaces of chamber portion 622 and join with facing surfaces of layers 407 and 408 or 507 and 508. In general, therefore, attachment element 621 is similar to attachment element 331, but includes an additional part of the fastening system on an opposite surface.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A garment for attenuating impact forces comprising:

an inner layer and an outer layer positioned adjacent to the inner layer such that an outwardly-facing surface of the inner layer contacts an inwardly-facing surface of the outer layer, the outwardly-facing surface of the inner layer and the inwardly-facing surface of the outer layer each having a first part of a fastening system, wherein the first part of the fastening system of the inner layer and the first part of the fastening system of the outer layer have the same structure; and an attachment element with an outwardly-facing surface that has a second part of the fastening system attached thereto, and an inwardly-facing surface that also has the second part of the fastening system attached thereto, wherein the second part of the fastening system has the same structure on each of the outwardly-facing surface and the inwardly facing surface of the attachment element;

wherein the inner layer underlies substantially all of the outer layer in at least one region of the garment, said at least one region of the garment being one of a torso region, a pelvic region, a left arm region, a right arm region, a left leg region and a right leg region;

wherein the second part of the fastening system has a structure that is different from and is complementary to the first part of the fastening system;

the first part of the fastening system being joinable to the second part of the fastening system to secure the attachment element to the garment such that the attachment element is attached to the inwardly-facing surface of the outer layer and to the outwardly-facing surface of the inner layer, and the first part of the fastening system being separable from the second part of the fastening system on both the inwardly-facing surface of the attachment element and the outwardly-facing surface of the attachment element to separate the attachment element from the garment; and wherein the attachment element includes at least one through aperture, the at least one through aperture extending through the second part of the fastening system on the inwardly facing surface, through the attachment element and through the second part of the fastening system on the outwardly facing surface.

2. The garment recited in claim 1, wherein the first part of the fastening system is a hook-and-loop fastening system part that forms at least twenty percent of each of the surface of the inner layer and the surface of the outer layer.

3. The garment recited in claim 1, wherein the first part of the fastening system is a hook-and-loop fastening system part that forms at least fifty percent of each of the surface of the inner layer and the surface of the outer layer.

4. The garment recited in claim 1, wherein the attachment element is a plate.

5. The garment recited in claim 4, wherein the attachment element comprises rubber.

6. The garment recited in claim 1, wherein the outer layer has a loose-fitting configuration and the inner layer provides a tight and stretchable fit.

7. The garment recited in claim 1, wherein the attachment element incorporates a polymer foam material.

8. The apparel system recited in claim 1, wherein the article of apparel is one of:

a shirt-type garment-type garment having a torso region and a pair of arm regions extending outward from the torso region, the first part of the fastening system being positioned in the torso region and in each of the arm regions; and a pants-type garment having a pelvic region and a pair of leg regions extending outward from the pelvic region, the first part of the fastening system being positioned in the pelvic region and in each of the leg regions.

9. The garment recited in claim 1, wherein at least one of the inner layer and the outer layer are formed from a textile that stretches at least thirty percent prior to tensile failure.

10. A garment for attenuating impact forces comprising:

an inner layer and an outer layer positioned adjacent to the inner layer such that an outwardly-facing surface of the inner layer contacts an inwardly-facing surface of the outer layer, at least twenty percent of the outwardly-facing surface of the inner layer and at least twenty percent of the inwardly-facing surface of the outer layer each having a first part of a hook-and-loop fastening system, wherein the first part of the hook-and-loop fastening system on the outwardly-facing surface of inner layer is the same as the first part of the hook-and-loop fastening system on the inwardly-facing surface of outer layer, at least one of the inner layer and the outer layer being formed from a textile that stretches at least thirty percent prior to tensile failure; and an attachment element at least partially formed from a compressible material, the attachment element having an outwardly-facing surface that has a second part of the hook-and-loop fastening system attached to it and an inwardly-facing surface that has the second part of the hook-and-loop fastening system attached to it, wherein the second part of the hook-and-loop fastening system is the same on each of the outwardly-facing surface and the inwardly-facing surface;

wherein the inner layer underlies substantially all of an upper area of the outer layer in at least one region of the garment, said at least one region of the garment being one of a torso region, a pelvic region, a left arm region, a right arm region, a left leg region and a right leg region, and wherein the first part of the hook-and-loop fastening system is different from and complementary to the second part of the hook-and-loop fastening system;

the first part of the hook-and-loop fastening system being joinable to the second part of the hook-and-loop fastening system to secure the attachment element to the garment such that the attachment element is attached to the inwardly-facing surface of the outer layer and to the outwardly-facing surface of the inner layer, and the first part of the hook-and-loop fastening system being separable from the second part of the hook-and-loop fastening system to separate the attachment element from the garment; and wherein the attachment element includes at least one through aperture, the at least one through aperture extending through the second part of the fastening system on the inwardly facing surface, through the attachment element and through the second part of the fastening system on the outwardly facing surface.

11. The garment recited in claim 10, wherein the compressible material is a polymer foam material.

12. The garment recited in claim 11, wherein at least one of the surfaces of the attachment element defines a plurality of indentations that form flexion lines.

13. The apparel system recited in claim 10, wherein the article of apparel is one of:

a shirt-type garment having a torso region and a pair of arm regions extending outward from the torso region, the first part of the hook-and-loop fastening system being positioned in the torso region and in each of the arm regions; and a pants-type garment having a pelvic region and a pair of leg regions extending outward from the pelvic region, the first part of the hook-and-loop fastening system being positioned in the pelvic region and in each of the leg regions.

14. A garment for covering at least a portion of a body of a wearer and being configured to attenuate impact forces, the garment having an inner layer and an outer layer, at least one of the inner layer and the outer layer being formed from a textile having two-directional stretch of at least thirty percent prior to tensile failure, the outer layer being positioned adjacent to the inner layer such that a surface of the outer layer contacts a surface of the inner layer, at least twenty percent of the outwardly-facing surface of the inner layer and at least twenty percent of the inwardly-facing surface of the outer layer each having a first part of a hook-and-loop fastening system, wherein the first part of the hook-and-loop fastening system on the outwardly-facing surface of inner layer and on the inwardly-facing surface of the outer layer have the same structure, wherein the inner layer underlies more than twenty percent of the outer layer in at least one region of the garment, said at least one region of the garment being one of a torso region, a pelvic region, a left arm region, a right arm region, a left leg region and a right leg region;

further comprising an attachment element with an outwardly-facing surface and an inwardly-facing surface that each have a second part of the hook-and-loop fastening system, the second part of the hook-and-loop system having a different structure than the first part of the hook-and-loop system, the first part of the hook-and-loop fastening system being joinable to the second part of the hook-and-loop fastening system to secure the attachment element to the garment such that it is attached to the outwardly-facing surface of the inner layer and to the inwardly-facing surface of the outer layer, and the first part of the hook-and-loop fastening system being separable from the second part of the hook-and-loop fastening system to separate the attachment element from the garment, and wherein the attachment element includes at least one incision dividing the attachment element into a first portion and a second portion, the first portion having a first edge and the second portion having a second edge, wherein the at least one incision extends through the second part of the fastening system on the outwardly-facing surface, the second part of the fastening system extends across the at least one incision on the inwardly facing surface, the first portion and the second portion directly abut each other along the entire first edge and the entire second edge when the attachment element is in a non-flexed position, and a tapered gap is formed between the first portion and the second portion when the attachment element is in a flexed position, the tapered gap having an open end on the outwardly facing surface and tapering towards a closed end on the inwardly facing surface.

15. The garment recited in claim 14, wherein the outer layer has a loose-fitting configuration and the inner layer provides a tight and stretchable fit.

16. The garment recited in claim 14, wherein the garment is a shirt-type garment having a torso region and a pair of arm regions extending outward from the torso region, at least a portion of each of the inner layer and the outer layer being located in the torso region and each of the arm regions.

17. The garment recited in claim 16, wherein the first part of the hook-and-loop fastening system is positioned in the torso region and in each of the arm regions.

18. The article of apparel recited in claim 14, wherein the article of apparel is a pants-type garment having a pelvic region and a pair of leg regions extending outward from the pelvic region, at least a portion of each of the inner layer and the outer layer being located in the pelvic region and each of the leg regions.

19. The article of apparel recited in claim 18, wherein the first part of the hook-and-loop fastening system is positioned in the pelvic region and in each of the leg regions.

20. The garment recited in claim 14, wherein the attachment element is at least partially formed from a polymer foam material.

21. A shirt-type garment configured to attenuate impact forces comprising:

a torso region that comprises an upper area and a pair of arm regions extending outward from the torso region, the shirt-type garment including an inner layer and an outer layer positioned adjacent to each other such that an outwardly-facing surface of the inner layer contacts an inwardly-facing surface of the outer layer, at least twenty percent of the outwardly-facing surface of the inner layer and at least twenty percent of the inwardly-facing surface of the outer layer each having a first part of a hook-and-loop fastening system, wherein the inner layer underlies substantially all of the upper area of the torso region of the outer layer of the garment;

wherein the first part of the hook-and-loop fastening system on the inner layer is the same as the first part of the hook-and-loop fastening system on the outer layer, and at least a portion of each of the inner layer and the outer layer being located in the torso region and each of the arm regions; and an attachment element sandwiched between the inner layer and the outer layer that is at least partially formed from a polymer foam material, the attachment element having an outwardly-facing surface and an inwardly-facing surface that each have a second part of the hook-and-loop fastening system, wherein the second part of the hook-and-loop fastening system is the same on the pair of opposing surfaces, and wherein the attachment element includes at least one incision dividing the attachment element into a first portion and a second portion, the first portion having a first edge and the second portion having a second edge, wherein the at least one incision extends through the second part of the fastening system on the outwardly-facing surface, the second part of the fastening system extends across the at least one incision on the inwardly facing surface, the first portion and the second portion directly abut each other along the entire first edge and the entire second edge when the attachment element is in a non-flexed position, and a tapered gap is formed between the first portion and the second portion when the attachment element is in a flexed position, the tapered gap having an open end on the outwardly facing surface and tapering towards a closed end on the inwardly facing surface; and wherein the first part of the hook-and-loop fastening system is different from and complementary to the second part of the hook-and-loop fastening system, the second part of the hook-and-loop fastening system on each of the outwardly-facing surface and the inwardly-facing surface being detachably-joinable to the first part of the hook-and-loop fastening system.

22. The garment recited in claim 21, wherein the first part of the hook-and-loop fastening system is positioned in the torso region and in each of the arm regions.

23. The garment recited in claim 1, wherein each of the inner layer and the outer layer includes the first part of the fastening system, with the first part of the fastening system being attached to each of the inner layer and the outer layer.

* * * * *